US008287665B2

(12) United States Patent
Urata et al.

(10) Patent No.: US 8,287,665 B2
(45) Date of Patent: Oct. 16, 2012

(54) SOFT MAGNETIC ALLOY, MAGNETIC PART USING SOFT MAGNETIC ALLOY, AND METHOD OF MANUFACTURING SAME

(75) Inventors: Akiri Urata, Sendai (JP); Hiroyuki Matsumoto, Sendai (JP); Akihiro Makino, Sendai (JP)

(73) Assignees: NEC Tokin Corporation, Sendai-shi, Miyagi (JP); Tohoku University, Sendai-shi, Miyagi (JP)

( * ) Notice: Subject to any disclaimer, the term of this patent is extended or adjusted under 35 U.S.C. 154(b) by 299 days.

(21) Appl. No.: 12/532,088

(22) PCT Filed: Mar. 19, 2008

(86) PCT No.: PCT/JP2008/000661

§ 371 (c)(1),
(2), (4) Date: Sep. 18, 2009

(87) PCT Pub. No.: WO2008/129803

PCT Pub. Date: Oct. 30, 2008

(65) Prior Publication Data

US 2010/0097171 A1 Apr. 22, 2010

(30) Foreign Application Priority Data

Mar. 20, 2007 (JP) ..... 2007-073496

(51) Int. Cl.
*H01F 1/147* (2006.01)

(52) U.S. Cl. ..... 148/306; 148/304; 148/307; 148/104; 148/121

(58) Field of Classification Search ..... None
See application file for complete search history.

(56) References Cited

U.S. PATENT DOCUMENTS

| | | | |
|---|---|---|---|
| 4,881,989 | A | 11/1989 | Yoshizawa et al. |
| 5,160,379 | A | 11/1992 | Yoshizawa et al. |
| 5,961,745 | A | 10/1999 | Inoue et al. |
| 6,425,960 | B1 | 7/2002 | Yoshizawa et al. |
| 2009/0266448 | A1 | 10/2009 | Ohta et al. |
| 2010/0043927 | A1 | 2/2010 | Makino |
| 2010/0139814 | A1 | 6/2010 | Makino |

FOREIGN PATENT DOCUMENTS

| | | | |
|---|---|---|---|
| EP | 1925686 | A1 | 5/2008 |
| JP | 2573606 | A | 12/1988 |
| JP | 2812574 | A | 8/1992 |
| JP | 5-263197 | A | 10/1993 |

(Continued)

OTHER PUBLICATIONS

Shen, Baolong et al., "Formation, ductile deformation behavior and soft-magnetic properties of (Fe, Co, Ni)—B—Si-Nb bulk glassy alloys," Intermetallics 15, (2007), pp. 9-16.

Y. Yoshizawa et al., "Fe Based Soft Magnetic Alloys Composed of Ultrafine Grain Structure," J. Japan Inst. Metals, vol. 53, No. 2 (Feb. 1989), pp. 241-248.

K. Yamauchi et al., "Iron Based Nanocrystalline Soft Magnetic Materials," Journal of Magnetics Society of Japan, vol. 14, No. 5, pp. 684-688, (1990).

(Continued)

*Primary Examiner* — John Sheehan

(74) *Attorney, Agent, or Firm* — Holtz, Holtz, Goodman & Chick, P.C.

(57) ABSTRACT

A soft magnetic alloy contains P, B, and Cu as essential components. As a preferred example, an Fe-based alloy contains Fe of 70 atomic % or more, B of 5 atomic % to 25 atomic %, Cu of 1.5 atomic % or less (excluding zero), and P of 10 atomic or less (excluding zero).

21 Claims, 3 Drawing Sheets

FOREIGN PATENT DOCUMENTS

| | | | | |
|---|---|---|---|---|
| JP | 7-11396 | A | | 1/1995 |
| JP | 9-320827 | A | | 12/1997 |
| JP | 11-071647 | A | | 3/1999 |
| JP | 2004-2949 | A | | 1/2004 |
| JP | 2004-349585 | A | | 12/2004 |
| JP | 2005-60805 | A | | 3/2005 |
| JP | 2005-290468 | A | | 10/2005 |
| JP | 2006-40906 | A | | 2/2006 |
| JP | 2007-107095 | A | | 4/2007 |
| JP | 2007-270271 | A | | 10/2007 |
| WO | WO 02/77300 | | * | 3/2002 |
| WO | WO 2007/032531 | | * | 3/2007 |
| WO | WO 2008/068899 | A1 | | 6/2008 |

OTHER PUBLICATIONS

K. Suzuki et al., "Low core losses of nanocrystalline Fe-M-B (M=Zr, Hf, or Nb) alloys," J. Appl. Phys. 74 (5), Sep. 1, 1993, 0021-8979/93/74(5), pp. 3316-3321.

H. Watanabe et al., "Soft Magnetic Properties and Structures of Nanocrystalline Fe-A1-Si-Nb-B Alloy Ribbons," Journal of Magnetics Society of Japan, vol. 17, No. 2, p. 191-196, (1993).

English Language International Search Report dated Jul. 1, 2008 issued in parent Appln. No. PCT/JP2008/000661.

Chinese Office Action dated Jan. 6, 2011, which issued in the counterpart Chinese Patent Application No. 200880008743.6, and a partial English-language translation thereof.

* cited by examiner

SOFT MAGNETIC ALLOY, MAGNETIC PART USING SOFT MAGNETIC ALLOY, AND METHOD OF MANUFACTURING SAME

This application is a U.S. National Phase Application under 35 USC 371 of International Application PCT/JP2008/000661 filed Mar. 19, 2008.

TECHNICAL FIELD

This invention relates to a soft magnetic alloy such as soft magnetic powder or a soft magnetic ribbon, a magnetic core and an inductor using the soft magnetic alloy, and a method of manufacturing the same.

BACKGROUND ART

Miniaturization and energy conservation of electronic devices have been demanded more intensively than before because of recent development of portable devices and recent needs for less environmental loads in consideration of the global warming. Accordingly, miniaturization, a higher frequency, a higher efficiency, a smaller thickness, and the like have been demanded more intensively than before with regard to magnetoelectronic parts used for electronic devices such as transformers and choke coils. Heretofore, Mn—Zn, Ni—Zn ferrite, and the like have frequently been used as a material for magnetoelectronic parts. However, those materials have recently been replaced with multilayer magnetic cores, wound magnetic cores, and dust cores of a magnetic metal material having a high saturation magnetic flux density with insulation by resin or the like. Among other things, a dust core is a magnetic core formed into a shape of a part by binding magnetic powder with a binder serving for insulation and bond. Because a dust core can readily form a three-dimensional shape, it expects a wide range of application and has attracted much attention.

Examples of a material for a magnetic core include Fe, Fe—Si, and Fe—Si—Cr, which have a relatively high saturation magnetic flux density. Furthermore, other examples include permalloy (Ni—Fe-based alloy) and Sendust (registered trademark; Fe—Si—Al alloy), which exhibit a small degree of magnetostriction and magnetic crystalline anisotropy and have an excellent soft magnetic property. However, those materials have the following problems. First, Fe, Fe—Si, and Fe—Si—Cr have a saturation magnetic flux density superior to other magnetic core materials but have a soft magnetic property inferior to other magnetic core materials. Permalloy and Sendust (registered trademark) have a soft magnetic property superior to other magnetic core materials but have a saturation magnetic flux density half of that of Fe or Fe—Si.

Meanwhile, amorphous soft magnetic materials have recently attracted much attention. This type of amorphous soft magnetic materials includes an Fe-based amorphous material and a Co-based amorphous material. Because an Fe-based amorphous material exhibits no magnetic crystalline anisotropy, it has a core loss lower than other magnetic core materials. However, an Fe-based amorphous material has a low capability of forming an amorphous phase. Therefore, an Fe-based amorphous material is limitedly used for ribbons having a thickness of 20 μm to 30 μm produced by a single-roll liquid quenching method or the like. A Co-based amorphous material may have a zero-magnetostriction composition and has an excellent soft magnetic property as compared to other magnetic core materials. However, a Co-based amorphous material has disadvantages in that it has a saturation magnetic flux density as low as that of a ferrite, includes a principal component of Co, which is expensive, and is thus unsuitable for commercial materials. For metallic glass alloys, Fe—Al—Ga—P—C—B—Si (Patent Documents 1 and 2) and (Fe, Co)—Si—B—Nb (Non-Patent Document 1), which have an excellent capability of forming an amorphous phase, have been reported in recent years. Because those materials have a low Fe content, the saturation magnetic flux density of those materials is greatly lowered to about 1.2 T. Furthermore, since those materials employ an expensive material such as Ga and Co, they are not preferable in the industrial aspect as with a Co-based amorphous material.

Furthermore, nanocrystalline materials, such as Fe—Cu—Nb—Si—B (Non-Patent Documents 2 and 3 and Patent Documents 3 and 4), Fe—(Zr,Hf,Nb)—B (Non-Patent Document 4 and Patent Document 5), and Fe—Al—Si—Nb—B (Non-Patent Document 5), have attracted much attention as magnetic core materials having a low magnetic coercive force and a high magnetic permeability. A nanocrystalline material is a material where nanocrystals of about several nanometers to about several tens of nanometers have been deposited in an amorphous texture. A nanocrystalline material has a magnetostriction lower than conventional Fe-based amorphous materials. Some nanocrystalline materials have a high saturation magnetic flux density. Here, a nanocrystalline material should have a high capability of forming an amorphous phase and have a composition capable of depositing nanocrystals because nanocrystals are deposited from an amorphous phase by heat treatment. However, the aforementioned nanocrystalline materials generally have a low capability of forming an amorphous phase.

Therefore, only ribbons having a thickness of about 20 μm can be produced by a single-roll liquid quenching method. Furthermore, powder cannot directly be produced by a method such as a water atomization method having a relatively low cooling rate. As a matter of course, a ribbon may be pulverized to produce powder. However, since a pulverization process is added, a manufacturing efficiency of a dust core is lowered. Additionally, it is difficult to control the grain diameter of powder in pulverization, and particles of the powder cannot be made spherical. Accordingly, it is difficult to improve the formability and the magnetic properties. Furthermore, there has been reported a nanocrystalline material capable of directly producing powder (Patent Document 4). However, as is apparent from the compositions in the examples, this nanocrystalline material is improved in the capability of forming an amorphous phase by reducing the Fe content and increasing the B content as compared to conventional nanocrystalline materials.

Therefore, it is apparent that the saturation magnetic flux density is lowered as compared to those conventional nanocrystalline materials. In any case, conventional compositions cannot provide a magnetic core material having an excellent soft magnetic property, a capability of forming an amorphous phase that is high enough to directly produce powder, and a high saturation magnetic flux density.

[Non-Patent Document 1] Baolong Shen, Chuntao Chang, and Akihisa Inoue, "Formation, ductile deformation behavior and soft-magnetic properties of (Fe,Co,Ni)—B—Si—Nb bulk glassy alloys," Intermetallics, 2007, Volume 15, Issue 1, p. 9.

[Non-Patent Document 2] Yamauchi and Yoshizawa, "Fe-based Soft Magnetic Alloy of Ultra-fine Grained Texture," Journal of the Japan Institute of Metals, the Japan Institute of Metals, February 1989, Vol. 53, No. 2, p. 241.

[Non-Patent Document 3] Yamauchi and Yoshizawa, "Fe-based Nanocrystalline Magnetic Material," Journal of the Magnetics Society of Japan, the Magnetics Society of Japan, 1990, Vol. 14, No. 5, p. 684.

[Non-Patent Document 4] Suzuki, Makino, Inoue, and Masumoto, "Low corelosses of nanocrystalline Fe-M-B (M=Zr, Hf, or Nb) alloys," Journal of Applied Physics, the American Institute of Physics, September 1993, Volume 74, Issue 5, p. 3316.

[Non-Patent Document 5] Watanabe, Saito, and Takahashi, "Soft Magnetic Property and Structure of Nanocrystalline Alloy Ribbon," Journal of the Magnetics Society of Japan, the Magnetics Society of Japan, 1993, Vol. 17, No. 2, p. 191.

| | |
|---|---|
| [Patent Document 1] | JP-A 09-320827 |
| [Patent Document 2] | JP-A 11-071647 |
| [Patent Document 3] | JP-B 2573606 |
| [Patent Document 4] | JP-A 2004-349585 |
| [Patent Document 5] | JP-B 2812574 |

DISCLOSURE OF INVENTION

Problem(s) to be Solved by the Invention

The present invention has been made in view of the above problems. It is therefore an object of the present invention to provide an amorphous or nanocrystalline soft magnetic alloy having an excellent soft magnetic property, a capability of forming an amorphous phase that is high enough to directly produce powder, and a high saturation magnetic flux density.

Means to Solve the Problem

The inventors have diligently studied a variety of alloy compositions to solve the aforementioned problems and have discovered that, when constituents of Fe-based alloys containing P, B, and Cu as essential ingredients are limited in various ways, a capability of forming an amorphous phase is improved so as to provide a soft magnetic ribbon, powder, or a member that has an amorphous phase. Furthermore, the inventors have discovered that α-Fe crystal phase (crystal grains having a bcc structure with a principal component of Fe) with an average grain diameter of 50 nm or less can be deposited within an amorphous phase by heat treatment within the scope of the present invention. Moreover, the inventors have discovered that use of such an amorphous or nanocrystalline ribbon or powder can provide a wound magnetic core, a multilayer magnetic core, a dust core, and an inductor having excellent magnetic properties. Then the inventors have completed the following invention based on those findings.

Specifically, the present invention provides a soft magnetic alloy containing Fe of 70 atomic % or more, B of 5 atomic % to 25 atomic %, Cu of 1.5 atomic % or less (excluding zero), and P of 10 atomic % or less (excluding zero), and being formed by rapidly cooling and solidifying an Fe-based alloy composition in a molten state.

The soft magnetic alloy may have an amorphous phase. The soft magnetic alloy may mainly have a mixed-phase texture of an amorphous phase and an α-Fe crystal phase dispersed in the amorphous phase with an average grain diameter of 50 nm or less.

EFFECT(S) OF THE INVENTION

According to the present invention, there can be provided a soft magnetic alloy capable of depositing an amorphous phase or nanocrystals with an excellent soft magnetic property and a high capability of forming an amorphous phase Furthermore, there can be provided a ribbon and powder using such a soft magnetic alloy, a wound magnetic core and a multilayer magnetic core using such a ribbon, and a dust core using such powder. Additionally, an inductor using such a core can be provided.

BRIEF DESCRIPTION OF DRAWINGS

FIG. 2(*b*) is a side view showing the inductor in which the coil can be seen through the inductor.

DESCRIPTION OF REFERENCE NUMERALS

Figure 1:
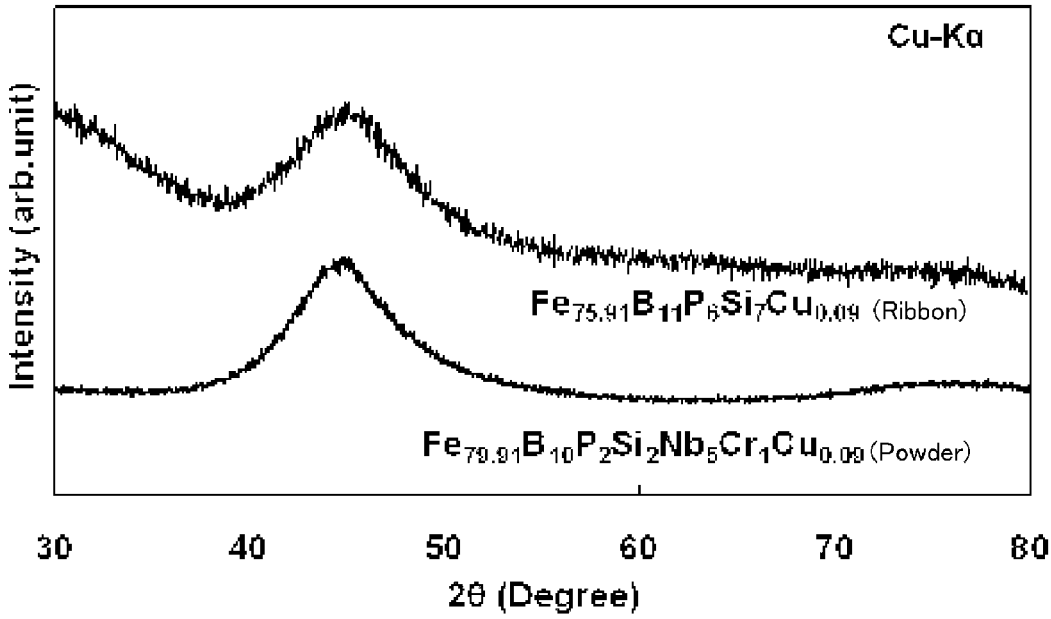
FIG. 1 is a graph showing X-ray diffraction profiles of a soft magnetic ribbon and a soft magnetic powder prior to heat treatment according to an example of the present invention, where the soft magnetic ribbon had a composition of $Fe_{75.91}B_{11}P_6Si_7Cu_{0.09}$ and the soft magnetic powder had a composition of $Fe_{79.91}B_{10}P_2Si_2Nb_5Cr_1Cu_{0.01}$.

1 Dust core
2 Coil
3 Terminal for surface mounting

Best Mode for Carrying Out the Invention

Preferred embodiments of the present invention will be described below in detail.

First, there will be described the composition and structure of a soft magnetic alloy according to a first embodiment. The inventors have diligently studied and have discovered that a ribbon, a bulk material, or powder that has an amorphous single phase and an excellent soft magnetic property can readily be produced with an Fe-based alloy component containing P, B, and Cu as essential ingredients. Furthermore, the inventors have also discovered that heat treatment on those alloys at a proper temperature can generate a mixed-phase texture in which an α-Fe crystal phase having an average grain diameter of 50 nm or less is dispersed in an amorphous phase and that use of such a ribbon or powder can provide a wound magnetic core, a multilayer magnetic core, a dust core, and an inductor having excellent magnetic properties.

Particularly, the inventors have discovered that a ribbon, a bulk material, or powder that has an amorphous single phase and an excellent soft magnetic property can readily be produced by limiting constituents of P, B, and Cu such that an Fe-based alloy has a component including Fe of 70 atomic % or more, B of 5-25 atomic %, Cu of 1.5 atomic % or less (excluding zero), and P of 10 atomic % or less (excluding zero).

In the above Fe-based alloy, Fe as a principal component is an element to provide magnetism and is essential for having magnetic properties. If the percentage of Fe is lower than 70 atomic %, then reduction of the saturation magnetic flux density is caused. Accordingly, it is preferable to maintain the percentage of Fe at 70 atomic % or more.

B is an element to form an amorphous phase and is essential for improving a capability of forming an amorphous phase. If the percentage of B is lower than 5 atomic %, then a sufficient capability of forming an amorphous phase cannot be obtained. Furthermore, if the percentage of B is higher than 25 atomic %, then the Fe content is relatively reduced, thereby causing reduction of the saturation magnetic flux density. Furthermore, it becomes difficult to produce a ribbon or powder due to a drastic increase of the melting point and a lowered capability of forming an amorphous phase.

Cu is an essential element. It is conceivable that Cu serves to decrease the grain diameter of nanocrystals. Furthermore, Cu serves to improve the capability of forming an amorphous phase when it is added together with P. If the percentage of Cu is higher than 1.5 atomic %, then the capability of forming an amorphous phase is lowered, making it difficult to directly produce powder. Therefore, it is preferable to maintain the percentage of Cu at 1.5 atomic % or less.

P is an element to form an amorphous phase as with B and is essential for improving a capability of forming an amorphous phase. If the percentage of P is higher than 10 atomic %, then the Fe content, which provides magnetism, is relatively reduced, which causes reduction of the saturation magnetic flux density. Furthermore, Fe—P compounds may be deposited after heat treatment, which causes deterioration of the soft magnetic property. Accordingly, it is preferable to maintain the percentage of P at 10 atomic % or less.

Here, the above Fe-based alloy composition has a supercooled liquid region represented by ΔTx (supercooled liquid region)=Tx (temperature at which crystallization starts)−Tg (glass transition temperature). Having ΔTx means that an amorphous phase is stable and that the capability of forming an amorphous phase is high. Therefore, the above Fe-based alloy composition can form an amorphous phase by methods having a cooling rate lower than that of a single-roll liquid quenching method, such as a water atomization method and a metal mold casting method, and thus has an improved capability of forming an amorphous phase. Furthermore, heat treatment at temperatures near Tg can completely reduce stress so as to exhibit an excellent soft magnetic property. Since heat treatment for depositing nanocrystals is performed through a region of ΔTx, the viscosity can be lowered so as to reduce stress in the powder. In order to obtain a higher capability of forming an amorphous phase and an excellent soft magnetic property, it is preferable to set ΔTx to be at least 20° C.

A soft magnetic alloy having an amorphous phase is produced by rapidly cooling the above Fe-based alloy composition in a molten state as described later. Furthermore, a soft magnetic alloy having a mixed-layer texture of an amorphous phase and an α-Fe crystal phase can be obtained by performing heat treatment on the amorphous soft magnetic alloy. The Fe-based alloy composition can provide a soft magnetic alloy having an amorphous phase or a mixed-layer texture of an amorphous phase and an α-Fe crystal phase, which has an excellent soft magnetic property, a low core loss, and a high saturation magnetic flux density. If the average grain diameter of α-Fe crystal grains is more than 50 nm, then deterioration of the soft magnetic property is caused. Therefore, it is preferable for the average grain diameter of the crystal grains to be 50 nm or less, more preferably 30 μm or less. If crystal grains are deposited in a rapid cooling state, the average grain diameter of the crystal grains should be 50 nm or less.

Next, there will be described a method of manufacturing an Fe-based alloy composition according to a first embodiment. First, an Fe-based alloy having the aforementioned composition is melted. Then the molten Fe-based alloy is rapidly cooled by a cooling method such as a single-roll liquid quenching method, a water atomization method, and a metal mold casting method, so that a soft magnetic ribbon, soft magnetic powder, or a soft magnetic member having an amorphous phase is produced. Here, heat treatment is performed on the produced soft magnetic ribbon or powder under such conditions of temperature and time that the amorphous state can be maintained, thereby reducing internal stress. Thus, the soft magnetic property can be improved. Furthermore, with heat treatment under at least a temperature at which crystals can be deposited, crystal grains of 50 nm or less are deposited in the amorphous phase. In other words, heat treatment provides a soft magnetic ribbon or powder having a mixed-layer texture of an amorphous phase and an α-Fe crystal phase. Here, if the heat treatment temperature is lower than 300° C., the internal stress cannot be reduced. If the heat treatment temperature is lower than 400° C., no α-Fe crystal phase is deposited. If the heat treatment temperature is higher than 700° C., the crystal grain diameter of the α-Fe crystal phase becomes more than 50 nm, thereby deteriorating the soft magnetic property. Therefore, for use in an amorphous state, it is preferable to perform heat treatment at a temperature in a range of from 300° C. to 600° C. Furthermore, in order to deposit crystal grains in an α-Fe crystal phase, it is preferable to perform heat treatment at a temperature in a range of from 400° C. to 700° C. because crystallization can be achieved even by maintaining a low temperature for a long period of time. For example, heat treatment is performed under an atmosphere such as vacuum, argon, or nitrogen. Nevertheless, heat treatment may be performed in the air. For example, the heat treatment period is in a range of from about 10 minutes to about 100 minutes. Furthermore, heat treatment may be performed in a magnetic field or under stress so as to adjust magnetic properties of the soft magnetic ribbon or powder.

Here, an Fe-based alloy composition of the first embodiment has features in adjustment of composition of the alloy, rapid cooling and solidification from a molten state for sufficiently exhibiting properties of the alloy, and an amorphous single phase or a mixed-phase texture of an amorphous and an α-Fe crystal phase of 50 nm or less which is obtained by heat treatment. Therefore, a conventional apparatus can be used as an apparatus for manufacturing the Fe-based alloy composition. That is, a conventional apparatus can be used except that it is necessary to provide a furnace that is capable of adjusting an atmosphere and controlling temperatures in a range of from 300° C. to 700° C. for a heat treatment process. For example, a conventional high-frequency heating apparatus or an arc melting apparatus can be used to obtain the master alloy. A single-roll liquid quenching apparatus or a twin-roll quenching apparatus can be used to produce the ribbon. A water atomization apparatus or a gas atomization apparatus can be used to produce the powder. A metal mold casting apparatus or an injection molding apparatus can be used to produce the bulk member.

Next, there will be described a method of manufacturing a wound magnetic core and a multilayer magnetic core using a soft magnetic ribbon of an Fe-based alloy composition according to the first embodiment. First, a soft magnetic ribbon prior to heat treatment is cut into a predetermined width, wound in the form of a ring, and fixed by an adhesive or weld, thereby forming a wound magnetic core. Furthermore, a soft magnetic ribbon prior to heat treatment is punched out into a predetermined shape. Those punched-out ribbons are stacked to form a multilayer magnetic core. Resin having a function of insulation or adhesion may be used as a binder between layers. Next, there will be described a method of manufacturing a dust core using soft magnetic powder of an Fe-based alloy composition according to the first embodiment. First, soft magnetic powder prior to heat treatment (soft magnetic powder having an amorphous phase) is bound to a binder to produce a mixture. Then the mixture is formed into a desired shape by a pressing machine or the like to produce a molded body. Finally, heat treatment is performed on the molded body to complete a dust core. Thermosetting high polymer is employed as a binder used for a wound magnetic core, a multilayer magnetic core, and a dust core. Depending upon application and required heat resistance, a proper binder can be selected. Examples of the binder include epoxy resin, unsaturated polyester resin, phenol resin, xylene resin, diallyl phthalate resin, silicone resin, polyamide-imide, and polyimide. As a matter of course, however, the present invention is not limited to those examples. If the molded body is used in an amorphous state, heat treatment is performed for stress reduction at such a temperature of about 300° C. to about 600° C. that no crystallization occurs. If the molded body is used in a nanocrystalline state, heat treatment is performed at a temperature in a range of from 400° C. to 700° C. so as to deposit crystal grains of 50 nm or less in the amorphous phase, so that deposition of crystal grains and reduction of internal stress generated by molding can be achieved at the same time. A wound magnetic core, a multilayer magnetic core, and a dust core may be manufactured with use of a soft magnetic ribbon or powder subjected to heat treatment, not a soft magnetic ribbon or powder prior to heat treatment. In this case, the last heat treatment process may be performed at such a heat treatment temperature as to harden a binder, and additional heat treatment may be performed for stress reduction. Basically, a conventional apparatus may be used as it is for the processes of manufacturing a wound magnetic core, a multilayer magnetic core, and a dust core.

Next, there will be described a method of manufacturing an inductor using a soft magnetic ribbon or powder of an Fe-based alloy composition according to the first embodiment. A wound magnetic core, a multilayer magnetic core, or a dust core is manufactured as described above. An inductor is completed by disposing the dust core near a coil. An inductor may be manufactured with use of a soft magnetic ribbon or powder subjected to heat treatment, not a soft magnetic ribbon or powder prior to heat treatment. In this case, the last heat treatment process may be performed at such a heat treatment temperature as to harden a binder, and additional heat treatment may be performed for stress reduction. Basically, a conventional apparatus may be used as it is for the processes of manufacturing an inductor. Next, there will be described a variation of the method of manufacturing an inductor using soft magnetic powder according to the first embodiment. First, soft magnetic powder prior to heat treatment is bound to silicone resin or the like and a binder to produce a mixture. Then the mixture and a coil are integrally formed into a desired shape by a pressing machine or the like to produce an integral molded body. If the integral molded body is used in an amorphous state, heat treatment is performed for stress reduction at such a temperature of about 300° C. to about 600° C. that no crystallization occurs. If the integral molded body is used in a nanocrystalline state, heat treatment is performed at a temperature in a range of from 400° C. to 700° C. so as to deposit crystal grains of 50 nm or less in the amorphous phase, so that an inductor is completed. An inductor may be manufactured with use of soft magnetic powder subjected to heat treatment, not soft magnetic powder prior to heat treatment. In this case, the last heat treatment process may be performed at such a heat treatment temperature as to harden a binder, and additional heat treatment may be performed for stress reduction. In the above variation, the coil incorporated with the dust core is also subjected to heat treatment. Therefore, heat resistance of an insulator in a wire forming the coil should be considered.

As described above, soft magnetic powder according to the first embodiment is formed of an Fe-based alloy containing P, B, and Cu as essential components. Therefore, it is possible to manufacture an amorphous ribbon, powder, or bulk member directly by a single-roll liquid quenching method, an atomization method, a metal mold casting method, or the like. Stress reduction can be achieved by performing heat treatment. Furthermore, crystal grains of 50 nm or less can be deposited in an amorphous phase so as to improve the soft magnetic property. Accordingly, a soft magnetic ribbon, powder, or bulk member according to the first embodiment has an excellent soft magnetic property, a high saturation magnetic flux density, and a low core loss. A wound magnetic core, a multilayer magnetic core, and a dust core having excellent properties can be obtained by using such a soft magnetic ribbon or powder. Furthermore, an inductor having more excellent properties can be obtained by using such a wound magnetic core, a multilayer magnetic core, or a dust core.

Next, there will be described the composition and structure of an Fe-based alloy composition according to a second embodiment. The inventors have further studied and have discovered that, if the composition of the Fe-based alloy in the first embodiment is further limited, it is possible to obtain a more excellent soft magnetic property and increase a capability of forming an amorphous phase to such a high degree as to readily form a ribbon by a single-roll liquid quenching method or the like or produce amorphous powder directly by a water atomization method or the like.

Specifically, the Fe-based alloy composition according to a second embodiment has components represented by the following formula (1).

$$(Fe_{1-a}M^1{}_a)_{100-b-c-d-e-f-g}M^2{}_bB_cP_dCu_eM^3{}_fM^4{}_g \quad (1)$$

where $M^1$ is at least one element of Co and Ni, $M^2$ is at least one element selected from the group consisting of Nb, Mo, Zr, Ta, W, Hf, Ti, V, Cr, and Mn, $M^3$ is at least one element selected from the group consisting of the elements of the platinum group, the rare-earth elements, Au, Ag, Zn, Sn, Sb, In, Rb, Sr, Cs, and Ba, $M^4$ is at least one element selected from the group consisting of C, Si, Al, Ga, and Ge, and a, b, c, d, e, f, and g are values that meet conditions that $0 \leqq a \leqq 0.5$, $0 \leqq b \leqq 10$, $5-c \leqq 25$, $0 < d \leqq 10$, $0 < e \leqq 1.5$, $0 \leqq f \leqq 2$, $0 \leqq g \leqq 8$, and $70 \leqq 100-b-c-d-e-f-g$. The elements of the platinum group include Pd, Pt, Rh, Ir, Ru, and Os. The rare-earth elements include Sc, Y, La, Ce, Pr, Nd, Sm, Eu, Gd, Tb, Dy, Ho, Er, Tm, Yb, and Ru.

In the above Fe-based alloy, Fe as a principal component is an element to provide magnetism and is essential for having magnetic properties as with the first embodiment.

$M^1$ is an element to provide magnetism as with Fe. Addition of $M^1$ enables adjustment of magnetostriction or impartation of induced magnetic anisotropy by heat treatment in an electric field or the like. However, if the percentage of $M^1$ meets $a>0.5$ in the formula (1), reduction of the saturation magnetic flux density or deterioration of the soft magnetic property may be caused. Accordingly, it is preferable to maintain the percentage of $M^1$ so as to meet $a \leqq 0.5$, more preferably $a \leqq 0.3$ in the formula (1).

$M^2$ is an element effective in enhancing the capability of forming an amorphous phase and facilitates production of a ribbon and powder. Furthermore, $M^2$ is also effective in suppressing growth of crystal grains in a nanocrystalline alloy. However, if the percentage of $M^2$ is higher than 10 atomic %, the Fe concentration is reduced so as to lower the saturation magnetic flux density. Therefore, it is preferable to maintain the percentage of $M^2$ at 10 atomic % or less. Furthermore, in order to obtain a high saturation magnetic flux density in an amorphous texture, it is preferable to maintain the percentage of $M^2$ at 5 atomic % or less. Moreover, in order to obtain crystal grains of 50 nm or less by heat treatment, it is preferable to maintain the percentage of $M^2$ at 1 atomic % or more for suppressing growth of crystal grains. Additionally, from the viewpoint of reduction of the capability of forming an amorphous phase or the saturation magnetic flux density and deterioration of the soft magnetic property because of increased tendency to deposit Fe-$M^2$ compounds, it is preferable to maintain the percentage of $M^2$ at 10 atomic % or less.

Furthermore, Cr of $M^4$ is an element to contribute to improvement of the resistivity of the Fe-based alloy composition and to improvement of high-frequency characteristics due to a passive layer on a surface of the composition. It is preferable to maintain Cr at 0.1 atomic % or more. It is also preferable to maintain Cr at 0.1 atomic % or more for production of powder by water atomization. Furthermore, it is preferable to maintain Cr at 1 atomic % or more for use in an environment that requires corrosion resistance. In this case, a step of rustproof treatment or the like can be omitted.

B is an element to form an amorphous phase and is essential for a high capability of forming an amorphous phase as with the first embodiment. However, if the percentage of B is lower than 5 atomic %, a sufficient capability of forming an amorphous phase cannot be obtained. Furthermore, if the percentage of B is higher than 25 atomic %, the Fe content is relatively reduced, thereby causing reduction of the saturation magnetic flux density. Furthermore, it becomes difficult to produce a ribbon or powder due to a drastic increase of the melting point and a lowered capability of forming an amorphous phase. Accordingly, it is preferable to maintain the percentage of B in a range of from 5 atomic % to 25 atomic %. Furthermore, in order to have a supercooled liquid region ΔTx and obtain an excellent capability of forming an amorphous phase, it is preferable to maintain the percentage of B in a range of from 5 atomic % to 20 atomic %. Moreover, in order to produce a nanocrystalline texture by heat treatment and obtain an excellent soft magnetic property, it is preferable to maintain the percentage of B in a range of from 5% to 18% for preventing deposition of Fe—B compounds, which have an inferior magnetic property.

P is an element to form an amorphous phase as with B and is essential for a high capability of forming an amorphous phase. However, if the percentage of P is higher than 10 atomic %, the Fe content, which provides magnetism, is relatively reduced, which may cause reduction of the saturation magnetic flux density. Accordingly, it is preferable to maintain the percentage of P at 10 atomic % or less. Furthermore, if the percentage of P is higher than 8 atomic %, Fe—P compounds may be deposited so as to cause deterioration of the soft magnetic property when heat treatment is performed to form nanocrystals. In this case, therefore, it is preferable to maintain the percentage of P at 8 atomic % or less, more preferably 5 atomic % or less. However, if the percentage of P is lower than 0.2 atomic %, the capability of forming an amorphous phase is lowered. Accordingly, it is preferable to maintain the percentage of P at 0.2 atomic % or more.

Cu serves to reduce the grain diameter of nanocrystals. Cu also serves to improve the capability of forming an amorphous phase when it is added together with P. It is necessary to contain Cu at 0.025 atomic % or more. Furthermore, if the percentage of Cu is higher than 1.5 atomic %, the capability of forming an amorphous phase is lowered. Accordingly, it is preferable to maintain the percentage of Cu at 1.5 atomic % or less. In order to form a nanocrystalline texture by heat treatment and have an excellent soft magnetic property and capability of forming an amorphous phase, it is preferable to maintain the percentage of Cu at 1 atomic % or less. Furthermore, in order to have a supercooled liquid region ΔTx in an amorphous state and obtain an excellent capability of forming an amorphous phase, it is preferable to maintain the percentage of Cu at 0.8 atomic % or less.

$M^3$ serves to reduce the crystal grain diameter of a crystal phase deposited by heat treatment. However, if the percentage of $M^3$ is higher than 2 atomic %, the capability of forming an amorphous phase is lowered, and the Fe content is relatively reduced so as to lower the saturation magnetic flux density. Accordingly, it is preferable to maintain the percentage of $M^3$ at 2 atomic % or less.

$M^4$ serves to promote improvement of the capability of forming an amorphous phase, to adjust magnetostriction, and to improve corrosion resistance when it is added together with B and P. However, if the percentage of $M^4$ is higher than 8 atomic %, the capability of forming an amorphous phase is lowered. Furthermore, when heat treatment is performed to form nanocrystals, compounds are deposited so as to cause deterioration of the soft magnetic property. Furthermore, the Fe content is relatively reduced so as to lower the saturation magnetic flux density. Accordingly, it is preferable to maintain the percentage of $M^4$ at 8 atomic % or less.

A method of manufacturing soft magnetic powder, a method of manufacturing a dust core, and a method of manufacturing an inductor are the same as in the first embodiment, and the explanation thereof is omitted herein.

As described above, an amorphous soft magnetic ribbon or powder according to the second embodiment is formed of an Fe-based alloy containing P, B, and Cu as essential components. Therefore, it has the same advantages as in the first embodiment. Furthermore, according to the second embodiment, the component of the Fe-based alloy of the first embodiment is further limited as compared to the first embodiment, and $M^1$ is added. Accordingly, magnetostriction can further be reduced as compared to the first embodiment. Furthermore, induced magnetic anisotropy can be impaired by heat treatment in an electric field or the like. Additionally, according to the second embodiment, the component of the Fe-based alloy of the first embodiment is further limited as compared to the first embodiment, and $M^2$ is added. Accordingly, the saturation magnetic flux density can further be increased as compared to the first embodiment. Furthermore, according to the second embodiment, the component of the Fe-based alloy of the first embodiment is further limited as compared to the first embodiment, and $M^3$ is added. Accordingly, deposited crystal grains can be made finer as compared to the first embodiment. Moreover, according to the third embodiment, the component of the Fe-based alloy of the first embodiment is further limited as compared to the first embodiment, and $M^4$ is added. Accordingly, it is possible to further improve the capability of forming an amorphous phase, reduce magnetostriction, and improve the corrosion resistance as compared to the first embodiment.

The present invention will be described below with specific examples.

EXAMPLES 1-24 AND COMPARATIVE EXAMPLES 1-6

Materials of Fe, B, $Fe_{75}P_{25}$, Si, $Fe_{80}C_{20}$, Cu, and Al were respectively weighed so as to provide alloy compositions of Examples 1-24 of the present invention and Comparative Examples 1-6 as listed in Table 1 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having various thicknesses, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon became the lowest. An increase of the maximum thickness $t_{max}$ means that an amorphous structure can be obtained with a low cooling rate and that the amorphous structure has a high capability of forming an amorphous phase. FIG. 1 shows, as a profile example, an X-ray diffraction profile of a ribbon having a thickness of 260 μm that was prepared with the composition of $Fe_{75.91}B_{11}P_6Si_7Cu_{0.09}$, which is included in the present invention. Next, thermal properties were evaluated for each ribbon under conditions of 40° C./minute (0.67° C./second) with use of DSC to calculate Tx (temperature at which crystallization starts) and Tg (glass transition temperature) and then calculate ΔTx (supercooled liquid region) from Tx and Tg. Furthermore, for ribbons of a fully amorphous single phase, the saturation magnetic flux density (Bs) was evaluated by a vibrating-sample magnetometer (VSM). Table 1 shows the measurement results of the saturation magnetic flux density Bs, the maximum thickness $t_{max}$, the X-ray diffraction results of ribbons having a thickness of 40 μm, and the ribbon width with regard to the amorphous alloys having compositions according to Examples 1-24 of the present invention and Comparative Examples 1-6.

TABLE 1

| | Alloy Composition (at %) | Bs (T) | $t_{max}$ (μm) | Tg (° C.) | X-ray Diffraction Results of 40-μm Ribbon | Ribbon Width (mm) |
|---|---|---|---|---|---|---|
| Comparative Example 1 | $Fe_{78}B_{13}Si_9$ | 1.54 | 35 | <20 | Crystal Phase | 2.8 |
| Example 1 | $Fe_{77.91}B_7P_8Si_7Cu_{0.09}$ | 1.54 | 110 | 21 | Amorphous Phase | 2.9 |
| Example 2 | $Fe_{77.91}B_9P_6Si_7Cu_{0.09}$ | 1.54 | 150 | 28 | Amorphous Phase | 2.9 |
| Example 3 | $Fe_{75.91}B_{11}P_6Si_7Cu_{0.09}$ | 1.54 | 260 | 51 | Amorphous Phase | 3.1 |
| Example 4 | $Fe_{74.91}B_{15}P_4Si_6Cu_{0.09}$ | 1.45 | 140 | 31 | Amorphous Phase | 3.2 |
| Example 5 | $Fe_{73.91}B_{20}P_2Si_4Cu_{0.09}$ | 1.35 | 50 | 24 | Amorphous Phase | 3.5 |
| Example 6 | $Fe_{70.91}B_{25}P_2Si_2Cu_{0.09}$ | 1.22 | 40 | <20 | Amorphous Phase | 3.4 |
| Comparative Example 2 | $Fe_{70.91}B_{27}P_1Si_1Cu_{0.09}$ | 1.24 | <20 | <20 | Crystal Phase | 3.1 |
| Comparative Example 3 | $Fe_{68.91}B_{17}P_6Si_8Cu_{0.09}$ | 1.18 | <20 | <20 | Crystal Phase | 3.4 |
| Example 7 | $Fe_{75.91}B_{16}P_1Si_7Cu_{0.09}$ | 1.54 | 80 | 22 | Amorphous Phase | 2.9 |
| Example 8 | $Fe_{75.91}B_{14}P_3Si_7Cu_{0.09}$ | 1.52 | 120 | 32 | Amorphous Phase | 3.3 |
| Example 9 | $Fe_{75.91}B_{12}P_6Si_6Cu_{0.09}$ | 1.51 | 240 | 48 | Amorphous Phase | 3.6 |
| Example 10 | $Fe_{75.91}B_8P_{10}Si_6Cu_{0.09}$ | 1.48 | 140 | 29 | Amorphous Phase | 3.1 |
| Comparative Example 4 | $Fe_{75.91}B_6P_{12}Si_6Cu_{0.09}$ | 1.44 | 35 | <20 | Crystal Phase | 3.4 |
| Example 11 | $Fe_{75.975}B_{11}P_6Si_7Cu_{0.025}$ | 1.54 | 240 | 51 | Amorphous Phase | 3.1 |
| Example 12 | $Fe_{75.8}B_{11}P_6Si_7Cu_{0.2}$ | 1.54 | 260 | 50 | Amorphous Phase | 3.1 |
| Example 13 | $Fe_{75.5}B_{11}P_6Si_7Cu_{0.5}$ | 1.54 | 170 | 38 | Amorphous Phase | 2.8 |
| Example 14 | $Fe_{75.2}B_{11}P_6Si_7Cu_{0.8}$ | 1.52 | 100 | 22 | Amorphous Phase | 3.3 |
| Example 15 | $Fe_{75}B_{11}P_6Si_7Cu_1$ | 1.52 | 55 | <20 | Amorphous Phase | 3.1 |
| Example 16 | $Fe_{74.5}B_{11}P_6Si_7Cu_{1.5}$ | 1.48 | 40 | <20 | Amorphous Phase | 3.1 |
| Comparative Example 5 | $Fe_{74}B_{11}P_6Si_7Cu_{2.0}$ | 1.42 | 20 | <20 | Crystal Phase | 3.2 |
| Example 17 | $Fe_{77.91}B_{16}P_5Si_1Cu_{0.09}$ | 1.56 | 45 | 21 | Amorphous Phase | 3.2 |
| Example 18 | $Fe_{77.91}B_{15}P_4Si_3Cu_{0.09}$ | 1.55 | 60 | 20 | Amorphous Phase | 3.1 |
| Example 19 | $Fe_{77.91}B_{14}P_3Si_5Cu_{0.09}$ | 1.53 | 80 | 26 | Amorphous Phase | 3.1 |
| Example 20 | $Fe_{77.91}B_{12}P_2Si_8Cu_{0.09}$ | 1.54 | 40 | 22 | Amorphous Phase | 3.1 |
| Comparative Example 6 | $Fe_{77.91}B_{11}P_1Si_{10}Cu_{0.09}$ | 1.52 | 30 | <20 | Crystal Phase | 3.4 |
| Example 21 | $Fe_{75.91}B_{11}P_6Si_6C_1Cu_{0.09}$ | 1.52 | 270 | 51 | Amorphous Phase | 3.3 |
| Example 22 | $Fe_{75.91}B_{11}P_6Si_4C_3Cu_{0.09}$ | 1.53 | 240 | 50 | Amorphous Phase | 3.4 |
| Example 23 | $Fe_{75.91}B_{11}P_6Si_2C_5Cu_{0.09}$ | 1.53 | 220 | 48 | Amorphous Phase | 2.9 |
| Example 24 | $Fe_{75.91}B_{11}P_6Si_5Al_2Cu_{0.09}$ | 1.50 | 190 | 50 | Amorphous Phase | 3.1 |

As shown in Table 1, each of the amorphous alloy compositions of Examples 1-24 had a saturation magnetic flux density Bs of at least 1.20 T, had a higher capability of forming an amorphous phase as compared to Comparative Example 1, which is a conventional amorphous composition including the Fe, Si, and B elements, and had a maximum thickness $t_{max}$ of at least 40 μm.

Among the compositions listed in Table 1, the compositions of Examples 1-6 and Comparative Example 2 correspond to cases where the value c of the B content in $(Fe_{1-a}M^1{}_a)_{100-b-c-d-e-f-g}M^2{}_bB_cP_dCu_eM^3{}_fM^4{}_g$ is varied from 7 atomic % to 27 atomic %. The cases of Examples 1-6 met conditions of Bs≧1.20 T and $t_{max}$≧40 μm. In these cases, a range of c≦25 defines a condition range for the parameter c of the present invention. In the case of Comparative Example 2 where c=27, the capability of forming an amorphous phase was lowered, so that the aforementioned conditions were not met. It is preferable to maintain the B content at 20 atomic % or less because Example 6 demonstrated that the glass transition temperature was lower than 20° C.

Among the compositions listed in Table 1, the compositions of Examples 1-6 and Comparative Example 3 correspond to cases where the value 100-b-c-d-e-f-g of the Fe content in $(Fe_{1-a}M^1{}_a)_{100-b-c-d-e-f-g}M^2{}_bB_cP_dCu_eM^3{}_fM^4{}_g$ is varied from 68.91 atomic % to 79.91 atomic %. The cases of Examples 1-6 met conditions of Bs≧1.20 T and $t_{max}$≧40 μm. In these cases, a range of 70.91≦100-b-c-d-e-f-g defines a condition range for the parameter 100-b-c-d-e-f-g of the present invention. In the case of Comparative Example 3 where 100-b-c-d-e-f-g=68.91, the saturation magnetic flux density Bs was lowered by reduction of the Fe content, so that the aforementioned conditions were not met.

Among the compositions listed in Table 1, the compositions of Examples 7-10 and Comparative Example 4 correspond to cases where the value d of the P content in $(Fe_{1-a}M^1{}_a)_{100-b-c-d-e-f-g}M^2{}_bB_cP_dCu_eM^3{}_fM^4{}_g$ is varied from 1 atomic % to 12 atomic %. The cases of Examples 7-10 met conditions of Bs≧1.20 T and $t_{max}$≧40 μm. In these cases, a range of d≦10 defines a condition range for the parameter d of the present invention. In the case of Comparative Example 4 where d=12, the capability of forming an amorphous phase was lowered, so that the aforementioned conditions were not met.

Among the compositions listed in Table 1, the compositions of Examples 11-16 and Comparative Example 5 correspond to cases where the value e of the Cu content in $(Fe_{1-a}M^1{}_a)_{100-b-c-d-e-f-g}M^2{}_bB_cP_dCu_eM^3{}_fM^4{}_g$ is varied from 0.025 atomic % to 2 atomic %. The cases of Examples 11-16 met conditions of Bs≧1.20 T and $t_{max}$≧40 μm. In these cases, a range of e≦1.5 defines a condition range for the parameter e of the present invention. In the case of Comparative Example 5 where e=2, the capability of forming an amorphous phase was lowered, so that the aforementioned conditions were not met.

Among the compositions listed in Table 1, the compositions of Examples 17-24 and Comparative Example 6 correspond to cases where the value g of the $M^4$ content in $(Fe_{1-a}M^1{}_a)_{100-b-c-d-e-f-g}M^2{}_bB_cP_dCu_eM^3{}_fM^4{}_g$ is varied from 0 atomic % to 10 atomic %. The cases of Examples 17-24 met conditions of Bs≧1.20 T and $t_{max}$≧40 μm. In these cases, a range of 0≦g≦8 defines a condition range for the parameter g of the present invention. In the case of Comparative Example 6 where g=10, the capability of forming an amorphous phase was lowered, so that the aforementioned conditions were not met.

EXAMPLES 25-47 AND COMPARATIVE EXAMPLES 7-16

Materials of Fe, B, $Fe_{75}P_{25}$, Si, $Fe_{80}C_{20}$, Al, and Cu were respectively weighed so as to provide alloy compositions of Examples 25-47 of the present invention and Comparative Examples 7-16 as listed in Table 2 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having various thicknesses, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon became the lowest. An increase of the maximum thickness $t_{max}$ means that an amorphous structure can be obtained with a low cooling rate and that the amorphous structure has a high capability of forming an amorphous phase. Furthermore, for ribbons of a fully amorphous single phase, the saturation magnetic flux density Bs was evaluated by VSM. Table 2 shows the measurement results of the saturation magnetic flux density Bs, the maximum thickness $t_{max}$, the X-ray diffraction results of ribbons having a thickness of 30 μm, and the ribbon width with regard to the amorphous alloys having compositions according to Examples 25-47 of the present invention and Comparative Examples 7-16.

TABLE 2

| | Alloy Composition (at %) | Bs (T) | $t_{max}$ (μm) | X-ray Diffraction Results of 30-μm Ribbon | Ribbon Width (mm) |
|---|---|---|---|---|---|
| Comparative Example 7 | $Fe_{78}B_{13}Si_9$ | 1.54 | 35 | Amorphous Phase | 2.8 |
| Comparative Example 8 | $Fe_{81}B_{10}Si_9$ | 1.62 | 25 | Crystal Phase | 3.2 |
| Comparative Example 9 | $Fe_{82}B_{10}Si_8$ | 1.62 | 15 | Crystal Phase | 2.8 |
| Comparative Example 10 | $Fe_{81.91}B_4P_7Si_7Cu_{0.09}$ | — | <20 | Crystal Phase | 3.1 |
| Example 25 | $Fe_{81.91}B_5P_5Si_8Cu_{0.09}$ | 1.59 | 30 | Amorphous Phase | 3.1 |
| Example 26 | $Fe_{81.91}B_7P_4Si_7Cu_{0.09}$ | 1.60 | 45 | Amorphous Phase | 3.1 |
| Example 27 | $Fe_{81.91}B_9P_2Si_7Cu_{0.09}$ | 1.62 | 55 | Amorphous Phase | 3.1 |
| Example 28 | $Fe_{81.91}B_{12}P_1Si_5Cu_{0.09}$ | 1.62 | 40 | Amorphous Phase | 3.1 |
| Comparative Example 11 | $Fe_{81.91}Si_7B_{11}Cu_{0.09}$ | 1.60 | 20 | Crystal Phase | 3.1 |
| Example 29 | $Fe_{81.71}B_{11}P_{0.2}Si_7Cu_{0.09}$ | 1.62 | 30 | Amorphous Phase | 2.7 |
| Example 30 | $Fe_{81.41}B_{11}P_{0.5}Si_7Cu_{0.09}$ | 1.61 | 45 | Amorphous Phase | 3.2 |
| Example 31 | $Fe_{81.91}B_{10}P_1Si_7Cu_{0.09}$ | 1.61 | 50 | Amorphous Phase | 3.4 |
| Comparative Example 12 | $Fe_{82}B_{10}P_1Si_7$ | 1.61 | 25 | Crystal Phase | 3.2 |
| Example 32 | $Fe_{81.975}B_9P_2Si_7Cu_{0.025}$ | 1.63 | 45 | Amorphous Phase | 2.8 |
| Example 33 | $Fe_{81.5}B_9P_2Si_7Cu_{0.05}$ | 1.62 | 50 | Amorphous Phase | 3.1 |
| Example 34 | $Fe_{81.7}B_9P_2Si_7Cu_{0.3}$ | 1.62 | 55 | Amorphous Phase | 3.0 |
| Example 35 | $Fe_{81.2}B_9P_2Si_7Cu_{0.8}$ | 1.61 | 35 | Amorphous Phase | 2.7 |
| Comparative Example 13 | $Fe_{81}B_9P_2Si_7Cu_1$ | — | <20 | Crystal Phase | 2.9 |
| Comparative Example 14 | $Fe_{81.91}B_{13}P_5Cu_{0.09}$ | 1.61 | 20 | Crystal Phase | 2.9 |
| Example 36 | $Fe_{81.91}B_{12}P_5Si_1Cu_{0.09}$ | 1.63 | 30 | Amorphous Phase | 3.1 |
| Example 37 | $Fe_{81.91}B_{13}P_4Si_1Cu_{0.09}$ | 1.63 | 30 | Amorphous Phase | 2.7 |
| Example 38 | $Fe_{81.91}B_{12}P_3Si_3Cu_{0.09}$ | 1.61 | 50 | Amorphous Phase | 3.0 |

TABLE 2-continued

| | Alloy Composition (at %) | Bs (T) | $t_{max}$ (μm) | X-ray Diffraction Results of 30-μm Ribbon | Ribbon Width (mm) |
|---|---|---|---|---|---|
| Example 39 | $Fe_{81.91}B_9P_2Si_7Cu_{0.09}$ | 1.62 | 55 | Amorphous Phase | 3.1 |
| Example 40 | $Fe_{81.91}B_8P_2Si_8Cu_{0.09}$ | 1.59 | 50 | Amorphous Phase | 2.9 |
| Comparative Example 15 | $Fe_{81.91}B_6P_2Si_{10}Cu_{0.09}$ | 1.58 | 25 | Crystal Phase | 2.9 |
| Example 41 | $Fe_{81.91}B_9P_2Si_6C_1Cu_{0.09}$ | 1.61 | 50 | Amorphous Phase | 2.8 |
| Example 42 | $Fe_{81.91}B_8P_2Si_5C_3Cu_{0.09}$ | 1.59 | 55 | Amorphous Phase | 3.4 |
| Example 43 | $Fe_{81.91}B_9P_2Si_6Al_1Cu_{0.09}$ | 1.59 | 55 | Amorphous Phase | 2.7 |
| Example 44 | $Fe_{78.9}B_8P_6Si_7Cu_{0.1}$ | 1.56 | 140 | Amorphous Phase | 3.2 |
| Example 45 | $Fe_{80.91}B_{10}P_2Si_7Cu_{0.09}$ | 1.60 | 85 | Amorphous Phase | 3.3 |
| Example 46 | $Fe_{81.91}B_9P_2Si_7Cu_{0.09}$ | 1.62 | 55 | Amorphous Phase | 3.1 |
| Example 47 | $Fe_{83.91}B_8P_1Si_7Cu_{0.09}$ | 1.64 | 35 | Amorphous Phase | 2.8 |
| Comparative Example 16 | $Fe_{85.91}B_7P_1Si_6Cu_{0.09}$ | — | <20 | Crystal Phase | 2.9 |

As shown in Table 2, each of amorphous alloy compositions of Examples 25-47 had an Fe content of at least 78 atomic %, a higher saturation magnetic flux density Bs of at least 1.55 T as compared to Comparative Example 7, which is a conventional amorphous composition including the Fe, Si, and B elements, a higher capability of forming an amorphous phase as compared to Comparative Examples 8 and 9, and a maximum thickness $t_{max}$ of at least 30 μm, with which an amorphous ribbon can readily be produced.

Among the compositions listed in Table 2, the compositions of Examples 25-28 and Comparative Example 10 correspond to cases where the value c of the B content in $(Fe_{1-a}M^1_a)_{100-b-c-d-e-f-g}M^2_bB_cP_dCu_eM^3_fM^4_g$ is varied from 4 atomic % to 12 atomic %. The cases of Examples 25-28 met conditions of Bs≧1.55 T and $t_{max}$≧30 μm. In these cases, a range of 5≦c defines a condition range for the parameter c of the present invention. In the case of Comparative Example 10 where c=4, the capability of forming an amorphous phase was lowered, and a ribbon having an amorphous single phase could not be obtained. Thus, the aforementioned conditions were not met.

Among the compositions listed in Table 2, the compositions of Examples 25-31 and Comparative Example 11 correspond to cases where the value d of the P content in $(Fe_{1-a}M^1_a)_{100-b-c-d-e-f-g}M^2_bB_cP_dCu_eM^3_fM^4_g$ is varied from 0 atomic % to 5 atomic %. The cases of Examples 25-31 met conditions of Bs≧1.55 T and $t_{max}$≧30 μm. In these cases, a range of 0.2≦d defines a condition range for the parameter d of the present invention. In the case of Comparative Example 11 where d=0, the capability of forming an amorphous phase was lowered, and a ribbon having an amorphous single phase could not be obtained. Thus, the aforementioned conditions were not met.

Among the compositions listed in Table 2, the compositions of Examples 32-35 and Comparative Examples 12 and 13 correspond to cases where the value e of the Cu content in $(Fe_{1-a}M^1_a)_{100-b-c-d-e-f-g}M^2_bB_cP_dCu_eM^3_fM^4_g$ is varied from 0 atomic % to 1 atomic %. The cases of Examples 32-35 met conditions of Bs≧1.55 T and $t_{max}$≧30 μm. In these cases, a range of 0.025≦e defines a condition range for the parameter e of the present invention. In the cases of Comparative Examples 12 and 13 where e=0 and 1, respectively, the capability of forming an amorphous phase was lowered, and a ribbon having an amorphous single phase could not be obtained. Thus, the aforementioned conditions were not met. In this manner, even addition of a trace of Cu has a great influence on the capability of forming an amorphous phase. Particularly, in the composition region where the Fe content is at least 78 atomic %, it is preferable to set the value e of the Cu content in a range of from 0.025 atomic % to 0.8 atomic %.

EXAMPLES 48-56 AND COMPARATIVE EXAMPLES 17 AND 18

Materials of Fe, Co, Ni, B, $Fe_{75}P_{25}$, Si, $Fe_{80}C_{20}$, and Cu were respectively weighed so as to provide alloy compositions of Examples 48-56 of the present invention and Comparative Examples 17 and 18 as listed in Table 3 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having various thicknesses, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon became the lowest. An increase of the maximum thickness $t_{max}$ means that an amorphous structure can be obtained with a low cooling rate and that the amorphous structure has a high capability of forming an amorphous phase. Furthermore, for ribbons of a fully amorphous single phase, the saturation magnetic flux density Bs was evaluated by VSM. Table 3 shows the measurement results of the saturation magnetic flux density Bs, the maximum thickness $t_{max}$, the X-ray diffraction results of ribbons having a thickness of 40 μm, and the ribbon width with regard to the amorphous alloys having compositions according to Examples 48-56 of the present invention and Comparative Examples 17 and 18.

TABLE 3

| | Alloy Composition (at %) | Bs (T) | $t_{max}$ (μm) | X-ray Diffraction Results of 40-μm ribbon | Ribbon Width (mm) |
|---|---|---|---|---|---|
| Comparative Example 17 | $Fe_{78}B_{13}Si_9$ | 1.54 | 35 | Crystal Phase | 2.8 |
| Example 48 | $Fe_{74.91}B_{12}P_6Si_7Cu_{0.09}$ | 1.50 | 250 | Amorphous Phase | 2.8 |

TABLE 3-continued

| | Alloy Composition (at %) | Bs (T) | $t_{max}$ (μm) | X-ray Diffraction Results of 40-μm ribbon | Ribbon Width (mm) |
|---|---|---|---|---|---|
| Example 49 | $(Fe_{0.8}Co_{0.2})_{74.91}B_{12}P_6Si_7Cu_{0.09}$ | 1.51 | 260 | Amorphous Phase | 2.7 |
| Example 50 | $(Fe_{0.7}Co_{0.3})_{74.91}B_{12}P_6Si_7Cu_{0.09}$ | 1.46 | 250 | Amorphous Phase | 3.1 |
| Example 51 | $(Fe_{0.5}Co_{0.5})_{74.91}B_{12}P_6Si_7Cu_{0.09}$ | 1.32 | 220 | Amorphous Phase | 2.7 |
| Comparative Example 18 | $(Fe_{0.3}Co_{0.7})_{74.91}B_{12}P_6Si_7Cu_{0.09}$ | 1.19 | 180 | Amorphous Phase | 3.4 |
| Example 52 | $(Fe_{0.7}Ni_{0.3})_{74.91}B_{12}P_6Si_7Cu_{0.09}$ | 1.30 | 140 | Amorphous Phase | 3.0 |
| Example 53 | $(Fe_{0.8}Co_{0.1}Ni_{0.1})_{74.91}B_{12}P_6Si_7Cu_{0.09}$ | 1.46 | 190 | Amorphous Phase | 3.1 |
| Example 54 | $(Fe_{0.8}Co_{0.2})_{81.91}B_9P_2Si_7Cu_{0.09}$ | 1.63 | 60 | Amorphous Phase | 2.9 |
| Example 55 | $(Fe_{0.8}Co_{0.2})_{74.91}B_{12}P_6Si_5C_2Cu_{0.09}$ | 1.50 | 65 | Amorphous Phase | 3.4 |
| Example 56 | $(Fe_{0.8}Co_{0.2})_{81.91}B_9P_2Si_5C_2Cu_{0.09}$ | 1.61 | 70 | Amorphous Phase | 3.2 |

As shown in Table 3, each of amorphous alloy compositions of Examples 48-56 had a saturation magnetic flux density Bs of at least 1.20 T, a higher capability of forming an amorphous phase as compared to Comparative Example 17, which is a conventional amorphous composition including the Fe, Si, and B elements, and a maximum thickness $t_{max}$ of at least 40 μm.

Among the compositions listed in Table 3, the compositions of Examples 48-56 and Comparative Example 18 correspond to cases where the value a of the $M^1$ content in $(Fe_{1-a}M^1_a)_{100-b-c-d-e-f-g}M^2_bB_cP_dCu_eM^3_fM^4_g$ is varied from 0 to 0.7. The cases of Examples 48-56 met conditions of Bs≧1.20 T and $t_{max}$≧40 μm. In these cases, a range of a≦0.5 defines a condition range for the parameter a of the present invention. In the case of Comparative Example 18 where a=0.7, the saturation magnetic flux density Bs was lowered, so that the aforementioned conditions were not met. Furthermore, an excessive addition of $M^1$ makes reduction of Bs significant, is not preferable in the industrial aspect because of high cost of the raw material, and lowers the capability of forming an amorphous phase. Accordingly, it is preferable to set the value a of the $M^1$ content at 0.3 or less.

EXAMPLES 57-90 AND COMPARATIVE EXAMPLES 19-22

Materials of Fe, Co, Ni, B, $Fe_{75}P_{25}$, Si, $Fe_{80}C_{20}$, Al, Cu, Nb, Cr, MO, Zr, Ta, W, Hf, Ti, V, Mn, Y, La, Nd, Sm, and Dy were respectively weighed so as to provide alloy compositions of Examples 57-90 of the present invention and Comparative Examples 19-22 as listed in Table 4 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having various thicknesses, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon became the lowest. An increase of the maximum thickness $t_{max}$ means that an amorphous structure can be obtained with a low cooling rate and that the amorphous structure has a high capability of forming an amorphous phase. Furthermore, for ribbons of a fully amorphous single phase, the saturation magnetic flux density Bs was evaluated by VSM. Table 4 shows the measurement results of the saturation magnetic flux density Bs, the maximum thickness $t_{max}$, the X-ray diffraction results of ribbons having a thickness of 40 μm, and the ribbon width with regard to the amorphous alloys having compositions according to Examples 57-90 of the present invention and Comparative Examples 19-22.

TABLE 4

| | Alloy Composition (at %) | Bs (T) | $t_{max}$ (μm) | X-ray Diffraction Results of 40-μm Ribbon | Ribbon Width (mm) |
|---|---|---|---|---|---|
| Comparative Example 19 | $Fe_{78}B_{13}Si_9$ | 1.54 | 35 | Crystal Phase | 2.8 |
| Example 57 | $Fe_{81.81}Si_8B_5P_5Cr_{0.1}Cu_{0.09}$ | 1.58 | 40 | Amorphous Phase | 3.2 |
| Example 58 | $Fe_{75.81}B_{11}P_6Si_7Cr_{0.1}Cu_{0.09}$ | 1.54 | 260 | Amorphous Phase | 3.3 |
| Example 59 | $Fe_{74.81}B_{15}P_4Si_6Cr_{0.1}Cu_{0.09}$ | 1.45 | 140 | Amorphous Phase | 3.1 |
| Example 60 | $Fe_{81.61}B_{11}P_{0.2}Si_7Cr_{0.1}Cu_{0.09}$ | 1.60 | 45 | Amorphous Phase | 2.8 |
| Example 61 | $Fe_{81.81}B_9P_2Si_7Cr_{0.1}Cu_{0.09}$ | 1.62 | 55 | Amorphous Phase | 3.1 |
| Example 62 | $Fe_{74.975}B_{11}P_6Si_7Cr_1Cu_{0.025}$ | 1.53 | 240 | Amorphous Phase | 2.9 |
| Example 63 | $Fe_{74.5}B_{11}P_6Si_7Cr_1Cu_{0.5}$ | 1.51 | 150 | Amorphous Phase | 3.3 |
| Example 64 | $Fe_{74.2}B_{11}P_6Si_7Cr_1Cu_{0.8}$ | 1.50 | 110 | Amorphous Phase | 3.2 |
| Example 65 | $Fe_{77.91}B_{10}P_5Si_7Cu_{0.09}$ | 1.56 | 130 | Amorphous Phase | 2.8 |
| Example 66 | $Fe_{76.91}B_{10}P_5Si_7Nb_1Cu_{0.09}$ | 1.47 | 140 | Amorphous Phase | 3.2 |
| Example 67 | $Fe_{74.91}B_{12}P_5Si_5Nb_3Cu_{0.09}$ | 1.33 | 160 | Amorphous Phase | 3.1 |

TABLE 4-continued

| | Alloy Composition (at %) | Bs (T) | $t_{max}$ (μm) | X-ray Diffraction Results of 40-μm Ribbon | Ribbon Width (mm) |
|---|---|---|---|---|---|
| Example 68 | $Fe_{72.91}B_{12}P_5Si_5Nb_5Cu_{0.09}$ | 1.21 | 150 | Amorphous Phase | 3.1 |
| Comparative Example 20 | $Fe_{70.91}B_{14}P_5Si_3Nb_7Cu_{0.09}$ | 1.02 | 150 | Amorphous Phase | 2.7 |
| Example 69 | $Fe_{76.91}B_{10}P_5Si_7Cr_1Cu_{0.09}$ | 1.46 | 140 | Amorphous Phase | 3.4 |
| Example 70 | $Fe_{74.91}B_{11}P_5Si_6Cr_3Cu_{0.09}$ | 1.34 | 160 | Amorphous Phase | 3.2 |
| Example 71 | $Fe_{72.91}B_{12}P_5Si_5Cr_5Cu_{0.09}$ | 1.23 | 130 | Amorphous Phase | 3.0 |
| Comparative Example 21 | $Fe_{70.91}B_{12}P_5Si_5Cr_7Cu_{0.09}$ | 1.05 | 110 | Amorphous Phase | 3.0 |
| Example 72 | $Fe_{74.91}B_{11}P_5Si_4C_2Cr_3Cu_{0.09}$ | 1.32 | 150 | Amorphous Phase | 3.4 |
| Example 73 | $Fe_{81.91}B_7P_2Si_7Cr_2Cu_{0.09}$ | 1.43 | 40 | Amorphous Phase | 3.1 |
| Example 74 | $Fe_{81.91}B_7P_2Si_5C_2Cr_2Cu_{0.09}$ | 1.43 | 45 | Amorphous Phase | 3.1 |
| Example 75 | $(Fe_{0.8}Co_{0.2})_{75.91}B_{11}P_5Si_6Cr_2Cu_{0.09}$ | 1.38 | 160 | Amorphous Phase | 2.7 |
| Example 76 | $Fe_{75.91}B_{11}P_5Si_6Nb_1Cr_1Cu_{0.09}$ | 1.38 | 170 | Amorphous Phase | 2.9 |
| Example 77 | $Fe_{75.91}B_{11}P_5Si_6Mo_2Cu_{0.09}$ | 1.35 | 160 | Amorphous Phase | 2.6 |
| Example 78 | $Fe_{75.91}B_{11}P_5Si_6Zr_2Cu_{0.09}$ | 1.39 | 150 | Amorphous Phase | 2.9 |
| Example 79 | $Fe_{75.91}B_{11}P_5Si_6Ta_2Cu_{0.09}$ | 1.35 | 150 | Amorphous Phase | 3.1 |
| Example 80 | $Fe_{75.91}B_{11}P_5Si_6W_2Cu_{0.09}$ | 1.32 | 130 | Amorphous Phase | 2.7 |
| Example 81 | $Fe_{75.91}B_{11}P_5Si_6Hf_2Cu_{0.09}$ | 1.34 | 140 | Amorphous Phase | 3.4 |
| Example 82 | $Fe_{75.91}B_{11}P_5Si_6Ti_2Cu_{0.09}$ | 1.37 | 90 | Amorphous Phase | 3.0 |
| Example 83 | $Fe_{75.91}B_{11}P_5Si_6V_2Cu_{0.09}$ | 1.39 | 130 | Amorphous Phase | 2.7 |
| Example 84 | $Fe_{75.91}B_{11}P_5Si_6Mn_2Cu_{0.09}$ | 1.38 | 140 | Amorphous Phase | 2.9 |
| Example 85 | $Fe_{77.41}B_{11}P_5Si_6Y_{0.5}Cu_{0.09}$ | 1.48 | 130 | Amorphous Phase | 2.9 |
| Example 86 | $Fe_{75.91}B_{11}P_5Si_6Y_2Cu_{0.09}$ | 1.36 | 65 | Amorphous Phase | 2.7 |
| Comparative Example 22 | $Fe_{74.91}B_{11}P_5Si_6Y_3Cu_{0.09}$ | 1.28 | 35 | Crystal Phase | 2.8 |
| Example 87 | $Fe_{77.41}B_{11}P_5Si_6La_{0.5}Cu_{0.09}$ | 1.50 | 140 | Amorphous Phase | 2.8 |
| Example 88 | $Fe_{77.41}B_{11}P_5Si_6Nd_{0.5}Cu_{0.09}$ | 1.49 | 130 | Amorphous Phase | 3.2 |
| Example 89 | $Fe_{77.41}B_{11}P_5Si_6Sm_{0.5}Cu_{0.09}$ | 1.49 | 150 | Amorphous Phase | 3.3 |
| Example 90 | $Fe_{77.41}B_{11}P_5Si_6Dy_{0.5}Cu_{0.09}$ | 1.44 | 130 | Amorphous Phase | 2.6 |

As shown in Table 4, each of amorphous alloy compositions of Examples 57-90 had a saturation magnetic flux density Bs of at least 1.20 T, a higher capability of forming an amorphous phase as compared to Comparative Example 19, which is a conventional amorphous composition including the Fe, Si, and B elements, and a maximum thickness $t_{max}$ of at least 40 μm.

Among the compositions listed in Table 4, the compositions of Examples 57-84 and Comparative Examples 20 and 21 correspond to cases where the value b of the $M^2$ content in $(Fe_{1-a}M^1{}_a)_{100-b-c-d-e-f-g}M^2{}_bB_eP_dCu_eM^3{}_fM^4{}_g$ is varied from 0 atomic % to 7 atomic %. The cases of Examples 55-73 met conditions of Bs≧1.20 T and $t_{max}$≧40 μm. In these cases, a range of b≦5 defines a condition range for the parameter b of the present invention. In the cases of Comparative Examples 20 and 21 where b=7, the saturation magnetic flux density Bs was lowered, so that the aforementioned conditions were not met.

Among the compositions listed in Table 4, the compositions of Examples 85-90 and Comparative Example 22 correspond to cases where the value f of the $M^3$ content in $(Fe_{1-a}M^1{}_a)_{100-b-c-d-e-f-g}M^2{}_bB_cP_dCu_eM^3{}_fM^4{}_g$ is varied from 0 atomic % to 3 atomic %. The cases of Examples 85-90 met conditions of Bs≧1.20 T and $t_{max}$≧40 μm. In these cases, a range of f≦2 defines a condition range for the parameter f of the present invention. In the case of Comparative Example 22 where f=3, the saturation magnetic flux density Bs was lowered, so that the aforementioned conditions were not met.

EXAMPLES 91-151 AND COMPARATIVE EXAMPLES 23-34

Materials of Fe, B, $Fe_{75}P_{25}$, Si, $Fe_{80}C_{20}$, Al, Cu, Nb, Mo, and Cr were respectively weighed so as to provide alloy compositions of Examples 91-151 of the present invention and Comparative Examples 23-34 as listed in Tables 5-1 and 5-2 below (hereinafter collectively referred to as Table 5) and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having a thickness of about 30 μm, a width of about 3 mm, and a length of about 5 m. A surface of each ribbon that did not contact with copper rolls at the time of quenching at which a cooling rate of the ribbon became the lowest was evaluated by an X-ray diffraction method. Furthermore, for ribbons of a fully amorphous single phase with a thickness of 30 μm, the saturation magnetic flux density Bs was evaluated by VSM and the magnetic coercive force Hc was evaluated by a direct-current BH tracer. No evaluation after heat treatment was made on the compositions that had a low capability of forming an amorphous phase and could not produce a ribbon having a thickness of 30 μm. Table 5 shows the measurement results of the X-ray diffraction results of ribbons having a thickness of 30 μm, and the saturation magnetic flux density Bs and the magnetic coercive force Hc after heat treatment with regard to the amorphous alloys having compositions according to Examples 91-151 of the present invention and Comparative Examples 23-34. Heat treatment was performed on each sample under conditions at a temperature of 600° C., which was not lower than the crystallization temperature of the sample, within an Ar atmosphere for 5 minutes, thereby depositing nanocrystals. However, heat treatment was performed on the examples having the P content of at least 5 atomic % at a temperature of 550° C. within an Ar atmosphere for 5 minutes, thereby depositing nanocrystals.

TABLE 5

| | Alloy Composition (at %) | X-ray Diffraction Results of 30-μm Ribbon | Bs After Heat Treatment (T) | Hc After Heat Treatment (A/m) |
|---|---|---|---|---|
| Comparative Example 23 | $Fe_{80.91}B_4P_5Si_5Nb_5Cu_{0.09}$ | Crystal Phase | — | — |
| Example 91 | $Fe_{80.91}B_5P_4Si_5Nb_5Cu_{0.09}$ | Amorphous Phase | 1.62 | 4 |
| Example 92 | $Fe_{81.91}B_8P_2Si_3Nb_5Cu_{0.09}$ | Amorphous Phase | 1.62 | 3 |
| Example 93 | $Fe_{81.91}B_{10}P_2Si_1Nb_5Cu_{0.09}$ | Amorphous Phase | 1.63 | 3 |
| Example 94 | $Fe_{83.91}B_8P_2Si_1Nb_5Cu_{0.09}$ | Amorphous Phase | 1.66 | 3 |
| Example 95 | $Fe_{80.91}B_{10}P_2Si_2Nb_5Cu_{0.09}$ | Amorphous Phase | 1.59 | 4 |
| Example 96 | $Fe_{81.91}B_{11}P_2Nb_5Cu_{0.09}$ | Amorphous Phase | 1.62 | 6 |
| Example 97 | $Fe_{79.91}B_{12}P_3Nb_5Cu_{0.09}$ | Amorphous Phase | 1.58 | 9 |
| Example 98 | $Fe_{77.91}B_{14}P_3Nb_5Cu_{0.09}$ | Amorphous Phase | 1.54 | 18 |
| Example 99 | $Fe_{75.6}B_{16}P_3Nb_5Cu_{0.4}$ | Amorphous Phase | 1.42 | 16 |
| Example 100 | $Fe_{74.2}B_{18}P_1Si_1Nb_5Cu_{0.8}$ | Amorphous Phase | 1.33 | 19 |
| Comparative Example 24 | $Fe_{73.2}B_{20}P_1Nb_5Cu_{0.8}$ | Amorphous Phase | 1.30 | 44 |
| Example 101 | $Fe_{81.81}B_8P_2Si_3Nb_5Cr_{0.1}Cu_{0.09}$ | Amorphous Phase | 1.61 | 4 |
| Example 102 | $Fe_{81.81}B_{10}P_2Si_1Nb_5Cr_{0.1}Cu_{0.09}$ | Amorphous Phase | 1.61 | 3 |
| Example 103 | $Fe_{79.81}B_{12}P_3Nb_5Cr_{0.1}Cu_{0.09}$ | Amorphous Phase | 1.57 | 8 |
| Example 104 | $Fe_{75.5}B_{16}P_3Nb_5Cr_{0.1}Cu_{0.4}$ | Amorphous Phase | 1.40 | 15 |
| Comparative Example 25 | $Fe_{81.91}B_{11}Si_2Nb_5Cu_{0.09}$ | Crystal Phase | — | — |
| Example 105 | $Fe_{81.91}B_{10.8}P_{0.2}Si_2Nb_5Cu_{0.09}$ | Amorphous Phase | 1.63 | 4 |
| Example 106 | $Fe_{81.91}B_9P_2Si_2Nb_5Cu_{0.09}$ | Amorphous Phase | 1.63 | 2 |
| Example 107 | $Fe_{81.91}B_7P_5Si_1Nb_5Cu_{0.09}$ | Amorphous Phase | 1.57 | 12 |
| Example 108 | $Fe_{78.91}B_6P_8Si_2Nb_5Cu_{0.09}$ | Amorphous Phase | 1.50 | 19 |
| Comparative Example 26 | $Fe_{77.91}B_5P_{10}Si_2Nb_5Cu_{0.09}$ | Amorphous Phase | 1.43 | 220 |
| Example 109 | $Fe_{81.81}B_{10.8}P_{0.2}Si_2Nb_5Cr_{0.1}Cu_{0.09}$ | Amorphous Phase | 1.61 | 4 |
| Example 110 | $Fe_{81.81}B_{10}P_2Si_1Nb_5Cr_{0.1}Cu_{0.09}$ | Amorphous Phase | 1.61 | 3 |
| Example 111 | $Fe_{81.81}B_7P_5Si_1Nb_5Cr_{0.1}Cu_{0.09}$ | Amorphous Phase | 1.57 | 12 |
| Comparative Example 27 | $Fe_{81}B_{11}P_2Si_1Nb_5$ | Crystal Phase | — | — |
| Example 112 | $Fe_{80.975}B_{11}P_2Si_1Nb_5Cu_{0.025}$ | Amorphous Phase | 1.60 | 14 |
| Example 113 | $Fe_{80.91}B_{11}P_2Si_1Nb_5Cu_{0.09}$ | Amorphous Phase | 1.61 | 3 |
| Example 114 | $Fe_{80.8}B_{11}P_2Si_1Nb_5Cu_{0.2}$ | Amorphous Phase | 1.58 | 3 |
| Example 115 | $Fe_{79.5}B_{10}P_2Si_3Nb_5Cu_{0.5}$ | Amorphous Phase | 1.58 | 5 |
| Example 116 | $Fe_{79}B_{10}P_2Si_3Nb_5Cu_1$ | Amorphous Phase | 1.56 | 5 |
| Comparative Example 28 | $Fe_{78.5}B_{10}P_2Si_3Nb_5Cu_{1.5}$ | Crystal Phase | — | — |
| Example 117 | $Fe_{79.975}B_{11}P_2Si_1Nb_5Cr_1Cu_{0.025}$ | Amorphous Phase | 1.60 | 14 |
| Example 118 | $Fe_{80.91}B_{10}P_2Si_1Nb_5Cr_1Cu_{0.09}$ | Amorphous Phase | 1.56 | 5 |
| Example 119 | $Fe_{78.5}B_{10}P_2Si_3Nb_5Cr_1Cu_{0.5}$ | Amorphous Phase | 1.58 | 5 |
| Example 120 | $Fe_{81.91}B_{11}P_2Nb_5Cu_{0.09}$ | Amorphous Phase | 1.62 | 6 |
| Example 121 | $Fe_{81.91}B_{10}P_2Si_1Nb_5Cu_{0.09}$ | Amorphous Phase | 1.63 | 3 |
| Example 122 | $Fe_{81.91}B_8P_2Si_3Nb_5Cu_{0.09}$ | Amorphous Phase | 1.62 | 6 |
| Example 123 | $Fe_{79.91}B_7P_2Si_6Nb_5Cu_{0.09}$ | Amorphous Phase | 1.56 | 8 |
| Example 124 | $Fe_{78.91}B_6P_2Si_8Nb_5Cu_{0.09}$ | Amorphous Phase | 1.46 | 7 |
| Comparative Example 29 | $Fe_{78.91}B_5P_1Si_{10}Nb_5Cu_{0.09}$ | Crystal Phase | — | — |
| Example 125 | $Fe_{81.91}B_9P_2Si_{1.5}C_{0.5}Nb_5Cu_{0.09}$ | Amorphous Phase | 1.55 | 4 |
| Example 126 | $Fe_{80.91}B_9P_2Si_2C_1Nb_5Cu_{0.09}$ | Amorphous Phase | 1.55 | 4 |
| Example 127 | $Fe_{79.91}B_9P_2Si_2C_2Nb_5Cu_{0.09}$ | Amorphous Phase | 1.55 | 7 |
| Example 128 | $Fe_{80.91}B_9P_2Si_2Al_1Nb_5Cu_{0.09}$ | Amorphous Phase | 1.52 | 13 |
| Comparative Example 30 | $Fe_{80.6}B_{10}P_4Si_5Cu_{0.4}$ | Amorphous Phase | 1.44 | 230 |
| Example 129 | $Fe_{80.6}B_8P_4Si_6Nb_1Cu_{0.4}$ | Amorphous Phase | 1.64 | 15 |
| Example 130 | $Fe_{79.6}B_8P_4Si_6Nb_2Cu_{0.4}$ | Amorphous Phase | 1.58 | 7 |
| Example 131 | $Fe_{80.91}B_{12}P_3Nb_4Cu_{0.09}$ | Amorphous Phase | 1.62 | 9 |
| Example 132 | $Fe_{80.91}B_{10}P_2Si_1Nb_6Cu_{0.09}$ | Amorphous Phase | 1.56 | 4 |
| Example 133 | $Fe_{79.91}B_8P_3Si_2Nb_5Cr_2Cu_{0.09}$ | Amorphous Phase | 1.49 | 9 |
| Example 134 | $Fe_{78.91}B_8P_1Si_2Nb_7Cr_3Cu_{0.09}$ | Amorphous Phase | 1.31 | 19 |
| Comparative Example 31 | $Fe_{76.91}B_8P_1Si_2Nb_9Cr_3Cu_{0.09}$ | Crystal Phase | — | — |
| Example 135 | $Fe_{80.91}B_{10}P_2Si_1Nb_5Cr_1Cu_{0.09}$ | Amorphous Phase | 1.56 | 5 |
| Example 136 | $Fe_{80.81}B_{10}P_3Si_1Nb_5Cr_{0.1}Cu_{0.09}$ | Amorphous Phase | 1.56 | 4 |
| Example 137 | $Fe_{80.91}B_{10}P_2Si_1Nb_5Mo_1Cu_{0.09}$ | Amorphous Phase | 1.53 | 4 |
| Example 138 | $Fe_{80.91}B_{10}P_2Si_1Nb_5Zr_1Cu_{0.09}$ | Amorphous Phase | 1.55 | 4 |
| Example 139 | $Fe_{80.91}B_{10}P_2Si_1Nb_4Zr_2Cu_{0.09}$ | Amorphous Phase | 1.55 | 3 |
| Example 140 | $Fe_{80.91}B_{10}P_2Si_1Nb_5Ta_1Cu_{0.09}$ | Amorphous Phase | 1.54 | 7 |
| Example 141 | $Fe_{80.91}B_{10}P_2Si_1Nb_5W_1Cu_{0.09}$ | Amorphous Phase | 1.52 | 12 |
| Example 142 | $Fe_{80.91}B_{10}P_2Si_1Nb_5Hf_1Cu_{0.09}$ | Amorphous Phase | 1.54 | 9 |
| Example 143 | $Fe_{80.71}B_{10}P_3Si_1Nb_5Ti_{0.2}Cu_{0.09}$ | Amorphous Phase | 1.58 | 7 |
| Example 144 | $Fe_{80.71}B_{10}P_3Si_1Nb_5V_{0.2}Cu_{0.09}$ | Amorphous Phase | 1.57 | 8 |
| Example 145 | $Fe_{80.71}B_{10}P_3Si_1Nb_5Mn_{0.2}Cu_{0.09}$ | Amorphous Phase | 1.58 | 5 |
| Example 146 | $Fe_{81.81}B_{10}P_2Si_1Nb_5Cu_{0.09}Pd_{0.1}$ | Amorphous Phase | 1.61 | 3 |

TABLE 5-continued

| | Alloy Composition (at %) | X-ray Diffraction Results of 30-μm Ribbon | Bs After Heat Treatment (T) | Hc After Heat Treatment (A/m) |
|---|---|---|---|---|
| Example 147 | $Fe_{80.91}B_{10}P_2Si_1Nb_5Cu_{0.09}Pd_1$ | Amorphous Phase | 1.57 | 8 |
| Example 148 | $Fe_{79.91}B_{10}P_2Si_1Nb_5Cu_{0.09}Pd_2$ | Amorphous Phase | 1.49 | 18 |
| Comparative Example 32 | $Fe_{78.91}B_{10}P_2Si_1Nb_5Cu_{0.09}Pd_3$ | Crystal Phase | — | — |
| Example 149 | $Fe_{81.61}B_{10}P_2Si_1Nb_5Y_{0.3}Cu_{0.09}$ | Amorphous Phase | 1.58 | 7 |
| Example 150 | $Fe_{81.61}B_{10}P_2Si_1Nb_5Nd_{0.3}Cu_{0.09}$ | Amorphous Phase | 1.59 | 18 |
| Example 151 | $Fe_{81.61}B_{10}P_2Si_1Nb_5Sm_{0.3}Cu_{0.09}$ | Amorphous Phase | 1.54 | 14 |
| Comparative Example 33 | $Fe_{73.5}Si_{13.5}B_9Nb_3Cu_1$ | Amorphous Phase | 1.23 | 2 |
| Comparative Example 34 | $Fe_{85}B_9Nb_6$ | Crystal Phase | — | — |

As shown in Table 5, each of amorphous alloy compositions of Examples 91-151 showed that nanocrystals were deposited by heat treatment at a temperature that was not lower than the crystallization temperature. Furthermore, each of those amorphous alloy compositions had a saturation magnetic flux density Bs of at least 1.30 T and a maximum thickness $t_{max}$ of at least 30 μM, with which ribbons can continuously be mass-produced. Moreover, each of those amorphous alloy compositions had a magnetic coercive force Hc of 20 A/m or less after heat treatment. Here, in order to meet the conditions of $t_{max} \geqq 30$ μm, the X-ray diffraction result of a ribbon having a thickness of 30 μm should demonstrate an amorphous phase.

Among the compositions listed in Table 5, the compositions of Examples 91-104 and Comparative Examples 23 and 24 correspond to cases where the value c of the B content in $(Fe_{1-a}M^1{}_a)_{100-b-c-d-e-f-g}M^2{}_bB_cP_dCu_eM^3{}_fM^4{}_g$ is varied from 4 atomic % to 20 atomic %. The cases of Examples 91-104 met conditions of $Bs \geqq 1.30$ T and $t_{max} \geqq 30$ μm. In these cases, a range of $5 \leqq c \leqq 18$ defines a condition range for the parameter c of the present invention. In the case of Comparative Example 23 where c=4, the capability of forming an amorphous phase was lowered. In the case of Comparative Example 24 where c=20, the magnetic coercive force Hc was lowered. Thus, the aforementioned conditions were not met in those comparative examples.

Among the compositions listed in Table 5, the compositions of Examples 105-111 and Comparative Examples 25 and 26 correspond to cases where the value d of the P content in $(Fe_{1-a}M^1{}_a)_{100-b-c-d-e-f-g}M^2{}_bB_cP_dCu_eM^3{}_fM^4{}_g$ is varied from 0 atomic % to 10 atomic %. The cases of Examples 105-111 met conditions of $Bs \geqq 1.30$ T and $t_{max} \geqq 30$ μm. In these cases, a range of $0.2 \leqq d \leqq 8$ defines a condition range for the parameter d of the present invention. In the cases of Comparative Examples 25 and 26 where d=0 and 10, respectively, the capability of forming an amorphous phase was lowered, so that the aforementioned conditions were not met.

Among the compositions listed in Table 5, the compositions of Examples 112-119 and Comparative Examples 27 and 28 correspond to cases where the value e of the Cu content in $(Fe_{1-a}M^1{}_a)_{100-b-c-d-e-f-g}M^2{}_bB_cP_dCu_eM^3{}_fM^4{}_g$ is varied from 0 atomic % to 1.5 atomic %. The cases of Examples 112-119 met conditions of $Bs \geqq 1.30$ T and $t_{max} \geqq 30$ μm. In these cases, a range of $0.025 \leqq e \leqq 1$ defines a condition range for the parameter e of the present invention. In the cases of Comparative Examples 27 and 28 where e=0 and 1.5, respectively, the capability of forming an amorphous phase was lowered, so that the aforementioned conditions were not met.

Among the compositions listed in Table 5, the compositions of Examples 120-128 and Comparative Example 29 correspond to cases where the value g of the $M^4$ content in $(Fe_{1-a}M^1{}_a)_{100-a-b-c-d-e-f-g}M^2{}_bB_cP_dCu_eM^3{}_fM^4{}_g$ is varied from 0 atomic % to 10 atomic %. The cases of Examples 120-128 met conditions of $Bs \geqq 1.30$ T and $t_{max} \geqq 30$ μm. In these cases, a condition range for the parameter g should preferably be a range of $g \leqq 8$. In the case of Comparative Example 29 where g=10, the capability of forming an amorphous phase was lowered, so that the aforementioned conditions were not met.

Among the compositions listed in Table 5, the compositions of Examples 129-145 and Comparative Examples 30 and 31 correspond to cases where the value b of the $M^2$ content in $(Fe_{1-a}M^1{}_a)_{100-b-c-d-e-f-g}M^2{}_bB_cP_dCu_eM^3{}_fM^4{}_g$ is varied from 0 atomic % to 12 atomic %. The cases of Examples 129-145 met conditions of $Bs \geqq 1.30$ T and $t_{max} \geqq 30$ μm. In these cases, a condition range for the parameter b should preferably be a range of $1 \leqq b \leqq 10$. In the case of Comparative Example 30 where b=0, the magnetic coercive force Hc was lowered. In the case of Comparative Example 31 where b=12, the capability of forming an amorphous phase was lowered. Thus, the aforementioned conditions were not met in those comparative examples.

Among the compositions listed in Table 5, the compositions of Examples 146-151 and Comparative Example 32 correspond to cases where the value f of the $M^3$ content in $(Fe_{1-a}M^1{}_a)_{100-b-c-d-e-f-g}M^2{}_bB_cP_dCu_eM^3{}_fM^4{}_g$ is varied from 0 atomic % to 3 atomic %. The cases of Examples 146-151 met conditions of $Bs \geqq 1.30$ T and $t_{max} \geqq 30$ μm. In these cases, a condition range for the parameter f should preferably be a range of $0 \leqq f \leqq 2$. In the case of Comparative Example 32 where f=3, the capability of forming an amorphous phase was lowered, so that the aforementioned conditions were not met.

EXAMPLES 152-158 AND COMPARATIVE EXAMPLES 35-37

Materials of Fe, Co, Ni, B, $Fe_{75}P_{25}$, Si, $Fe_{80}C_{20}$, Al, Cu, Nb, Mo, and Cr were respectively weighed so as to provide alloy compositions of Examples 152-158 of the present invention and Comparative Examples 35-37 as listed in Table 6 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having a thickness of about 30 μM, a width of about 3 mm, and a length of about 5 m. A surface of each ribbon that did not contact with copper rolls at the time of quenching at which a cooling rate of the ribbon became the lowest was evaluated by an X-ray diffraction method. Furthermore, for ribbons of a fully amorphous single phase with a thickness of 30 μM, the saturation magnetic flux density Bs was evaluated by VSM and the magnetic coercive force Hc was evaluated by a direct-current BH tracer. No evaluation after heat treatment was made on the compositions that had a low capability of forming an amorphous phase and could not produce a ribbon having a thickness of 30 μm. Table 6 shows the measurement results of the X-ray diffraction results of ribbons having a thickness of 30 μm, and the saturation magnetic flux density Bs and the magnetic coercive force Hc after heat treatment with regard to the amorphous alloys having compositions according to Examples 152-158 of the present invention and Comparative Examples 35-37. Heat treatment was performed on each sample under conditions at a temperature of 600° C., which was not lower than the crystallization temperature of the sample, within an Ar atmosphere for 5 minutes, thereby depositing nanocrystals.

TABLE 6

| | Alloy Composition (at %) | X-ray Diffraction Results of 30-μm Ribbon | Bs after Heat Treatment (T) | Hc after Heat Treatment (A/m) |
|---|---|---|---|---|
| Example 152 | $Fe_{80.91}B_{10}P_2Si_2Nb_5Cu_{0.09}$ | Amorphous Phase | 1.59 | 4 |
| Example 153 | $(Fe_{0.95}Co_{0.05})_{80.91}B_{10}P_2Si_2Nb_5Cu_{0.09}$ | Amorphous Phase | 1.60 | 6 |
| Example 154 | $(Fe_{0.9}Co_{0.1})_{80.91}B_{10}P_2Si_2Nb_5Cu_{0.09}$ | Amorphous Phase | 1.58 | 5 |
| Example 155 | $(Fe_{0.7}Co_{0.3})_{80.91}B_{10}P_2Si_2Nb_5Cu_{0.09}$ | Amorphous Phase | 1.46 | 5 |
| Example 156 | $(Fe_{0.5}Co_{0.5})_{80.91}B_{10}P_2Si_2Nb_5Cu_{0.09}$ | Amorphous Phase | 1.37 | 12 |
| Comparative Example 35 | $(Fe_{0.3}Co_{0.7})_{80.91}B_{10}P_2Si_2Nb_5Cu_{0.09}$ | Amorphous Phase | 1.21 | 18 |
| Example 157 | $(Fe_{0.9}Ni_{0.1})_{80.91}B_{10}P_2Si_2Nb_5Cu_{0.09}$ | Amorphous Phase | 1.47 | 8 |
| Example 158 | $(Fe_{0.8}Co_{0.1}No_{0.1})_{80.91}B_{10}P_2Si_2Nb_5Cu_{0.09}$ | Amorphous Phase | 1.49 | 8 |
| Comparative Example 36 | $Fe_{73.5}Si_{13.5}B_9Nb_3Cu_1$ | Amorphous Phase | 1.23 | 2 |
| Comparative Example 37 | $Fe_{85}B_9Nb_6$ | Crystal Phase | — | — |

As shown in Table 6, each of amorphous alloy compositions of Examples 152-158 showed that nanocrystals were deposited by heat treatment at a temperature that was not lower than the crystallization temperature. Furthermore, each of those amorphous alloy compositions had a saturation magnetic flux density Bs of at least 1.30 T and a maximum thickness $t_{max}$ of at least 30 μM, with which ribbons can continuously be mass-produced. Moreover, each of those amorphous alloy compositions had a magnetic coercive force Hc of 20 A/m or less after heat treatment. Here, in order to meet the conditions of $t_{max} \geqq 30$ μm, the X-ray diffraction result of a ribbon having a thickness of 30 μm should demonstrate an amorphous phase.

Among the compositions listed in Table 6, the compositions of Examples 152-158 and Comparative Example 35 correspond to cases where the value a of the $M^1$ content in $(Fe_{1-a}M^1{}_a)_{100-b-c-d-e-f-g}M^2{}_bB_cP_dCu_eM^3{}_fM^4{}_g$ is varied from 0 to 0.7. The cases of Examples 152-158 met conditions of $Bs \geqq 1.30$ T and $t_{max} \geqq 30$ μm. In these cases, a range of $0 \leqq a \leqq 0.5$ defines a condition range for the parameter a of the present invention. In the case of Comparative Example 35 where a=0.7, the saturation magnetic flux density Bs was lowered, so that the aforementioned conditions were not met. Furthermore, an excessive addition of $M^1$ makes reduction of Bs significant, is not preferable in the industrial aspect because of high cost of the raw material, and lowers the capability of forming an amorphous phase. Accordingly, it is preferable to set the value a of the $M^1$ content at 0.3 or less.

EXAMPLES 159-193 AND COMPARATIVE EXAMPLES 38-48

Materials of Fe, B, $Fe_{75}P_{25}$, Al, $Fe_{80}C_{20}$, Al, Cu, Nb, Cr, Mo, Ta, W, and Al were respectively weighed so as to provide alloy compositions of Examples 159-193 of the present invention and Comparative Examples 38-48 as listed in Table 7 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a water atomization method so as to produce soft magnetic powders having an average grain diameter of 10 μm. Measurement using an X-ray diffraction method was performed on the powders to determine a phase. Furthermore, for powders of a fully amorphous single phase, the saturation magnetic flux density Bs was evaluated by VSM. No evaluation was made on the soft magnetic powders that had a low capability of forming an amorphous phase and deposited crystals thereon. Next, each of the powders prior to heat treatment was mixed and granulated with a solution of silicone resin such that a weight ratio of the soft magnetic powder and the solid content of the silicone resin was 100/5. Press forming was conducted on the granulated powders under a forming pressure of 1000 MPa so as to produce molded bodies (dust cores) having a toroidal shape with an outside diameter of 18 mm, an inside diameter of 12 mm, and a thickness of 3 mm. Then heat treatment was performed on each molded body to harden the silicone resin as a binder, thereby producing dust cores for evaluation. Furthermore, forming and heat treatment were conducted under the same conditions on the powder having the Fe composition and the powder having the $Fe_{88}Si_3Cr_9$ composition produced by water atomization, as conventional materials, thereby producing dust cores for evaluation. The core loss of those dust cores was measured under excitation conditions of 100 kHz and 100 mT with use of an alternating current BH analyzer. At that time, heat treatment was performed on each sample at a temperature of 400° C. for 60 minutes. Furthermore, heat treatment was performed on the Fe powder at a temperature of 500° C. for 60 minutes and on the $Fe_{88}Si_3Cr_9$ powder at a temperature of 700° C. for 60 minutes. Table 7 shows the measurement results of the X-ray diffraction results, the saturation magnetic flux density Bs, the core loss Pcv after heat treatment with regard to the powders having the amorphous alloy compositions according to Examples 159-193 of the present invention and Comparative Examples 38-48.

As shown in Table 7, each of the amorphous alloy compositions of Examples 159-193 could produce powder of an amorphous single phase having an average grain diameter of 10 μm by a water atomization method. Each of the amorphous alloy compositions had a saturation magnetic flux density Bs of at least 1.20 T and had a core loss Pcv less than 4900 mW/cc after heat treatment.

Among the compositions listed in Table 7, the compositions of Examples 159-166 and Comparative Examples 39 and 40 correspond to cases where the value c of the B content in $(Fe_{1-a}M^1{}_a)_{100-b-c-d-e-f-g}M^2{}_bB_cP_dCu_eM^3{}_fM^4{}_g$ is varied from 3 atomic % to 22 atomic %. In the cases of Examples 159-166, powder having an amorphous single phase could be obtained. These cases met conditions of Bs≧1.20 T and Pcv<4900

TABLE 7

| | Alloy Composition (at %) | X-ray Diffraction Results | Bs (T) | Pcv (mW/cc) |
|---|---|---|---|---|
| Comparative Example 38 | $Fe_{78}B_{13}Si_9$ | Crystal Phase | — | — |
| Example 159 | $Fe_{75.91}B_{11}P_6Si_7Cu_{0.09}$ | Amorphous Phase | 1.52 | 1000 |
| Example 160 | $Fe_{80.91}B_9P_3Si_7Cu_{0.09}$ | Amorphous Phase | 1.59 | 1480 |
| Comparative Example 39 | $Fe_{78.91}B_4P_8Si_8Cr_1Cu_{0.09}$ | Crystal Phase | — | — |
| Example 161 | $Fe_{78.91}B_5P_7Si_8Cr_1Cu_{0.09}$ | Amorphous Phase | 1.46 | 1450 |
| Example 162 | $Fe_{77.91}B_8P_5Si_8Cr_1Cu_{0.09}$ | Amorphous Phase | 1.45 | 1020 |
| Example 163 | $Fe_{77.91}B_{12}P_3Si_6Cr_1Cu_{0.09}$ | Amorphous Phase | 1.46 | 1060 |
| Example 164 | $Fe_{77.91}B_{15}P_2Si_4Cr_1Cu_{0.09}$ | Amorphous Phase | 1.46 | 1320 |
| Example 165 | $Fe_{73.91}B_{18}P_3Si_4Cr_1Cu_{0.09}$ | Amorphous Phase | 1.41 | 1550 |
| Example 166 | $Fe_{72.91}B_{20}P_3Si_3Cr_1Cu_{0.09}$ | Amorphous Phase | 1.39 | 1880 |
| Comparative Example 40 | $Fe_{71.91}B_{22}P_2Si_3Cr_1Cu_{0.09}$ | Crystal Phase | — | — |
| Comparative Example 41 | $Fe_{75.91}B_{16}Si_7Cr_1Cu_{0.09}$ | Crystal Phase | — | — |
| Example 167 | $Fe_{75.71}B_{16}P_{0.2}Si_7Cr_1Cu_{0.09}$ | Amorphous Phase | 1.41 | 1520 |
| Example 168 | $Fe_{75.91}B_{15}P_1Si_7Cr_1Cu_{0.09}$ | Amorphous Phase | 1.43 | 1480 |
| Example 169 | $Fe_{75.91}B_{13}P_3Si_7Cr_1Cu_{0.09}$ | Amorphous Phase | 1.41 | 1440 |
| Example 170 | $Fe_{75.91}B_{11}P_6Si_6Cr_1Cu_{0.09}$ | Amorphous Phase | 1.40 | 1120 |
| Example 171 | $Fe_{75.91}B_7P_{10}Si_6Cr_1Cu_{0.09}$ | Amorphous Phase | 1.38 | 1920 |
| Comparative Example 42 | $Fe_{74.91}B_6P_{12}Si_6Cr_1Cu_{0.09}$ | Crystal Phase | — | — |
| Comparative Example 43 | $Fe_{81}Si_7B_{10}P_1Cr_1$ | Crystal Phase | — | — |
| Example 172 | $Fe_{79.975}B_9P_3Si_7Cr_1Cu_{0.025}$ | Amorphous Phase | 1.46 | 1200 |
| Example 173 | $Fe_{79.91}B_9P_3Si_7Cr_1Cu_{0.09}$ | Amorphous Phase | 1.46 | 1000 |
| Example 174 | $Fe_{79.7}B_9P_3Si_7Cr_1Cu_{0.3}$ | Amorphous Phase | 1.46 | 1020 |
| Example 175 | $Fe_{79.4}B_9P_3Si_7Cr_1Cu_{0.6}$ | Amorphous Phase | 1.44 | 1300 |
| Example 176 | $Fe_{76.2}B_{10}P_5Si_7Cr_1Cu_{0.8}$ | Amorphous Phase | 1.38 | 1280 |
| Example 177 | $Fe_{75}B_{10}P_5Si_8Cr_1Cu_1$ | Amorphous Phase | 1.34 | 1650 |
| Comparative Example 44 | $Fe_{75.5}B_{10}P_5Si_7Cr_1Cu_{1.5}$ | Crystal Phase | — | — |
| Example 178 | $Fe_{77.91}B_{16}P_5Si_1Cu_{0.09}$ | Amorphous Phase | 1.45 | 1490 |
| Example 179 | $Fe_{77.91}B_{15}P_4Si_3Cu_{0.09}$ | Amorphous Phase | 1.45 | 1280 |
| Example 180 | $Fe_{77.91}B_{14}P_3Si_5Cu_{0.09}$ | Amorphous Phase | 1.44 | 1290 |
| Example 181 | $Fe_{77.91}B_{12}P_2Si_8Cu_{0.09}$ | Amorphous Phase | 1.42 | 1080 |
| Comparative Example 45 | $Fe_{77.91}B_{11}P_1Si_{10}Cu_{0.09}$ | Crystal Phase | — | — |
| Example 182 | $Fe_{75.91}B_{11}P_6Si_6C_1Cu_{0.09}$ | Amorphous Phase | 1.41 | 1080 |
| Example 183 | $Fe_{75.91}B_{11}P_6Si_4C_3Cu_{0.09}$ | Amorphous Phase | 1.41 | 1060 |
| Example 184 | $Fe_{75.91}B_{11}P_6Si_2C_5Cu_{0.09}$ | Amorphous Phase | 1.41 | 1210 |
| Example 185 | $Fe_{75.91}B_{11}P_6Si_5Al_2Cu_{0.09}$ | Amorphous Phase | 1.38 | 1420 |
| Example 186 | $Fe_{78.81}B_8P_5Si_8Cr_{0.1}Cu_{0.09}$ | Amorphous Phase | 1.45 | 990 |
| Example 187 | $Fe_{78.91}B_9P_4Si_6Nb_1Cr_1Cu_{0.09}$ | Amorphous Phase | 1.41 | 1000 |
| Example 188 | $Fe_{77.91}B_9P_4Si_6Nb_2Cr_1Cu_{0.09}$ | Amorphous Phase | 1.33 | 950 |
| Example 189 | $Fe_{75.91}B_9P_4Si_6Nb_4Cr_1Cu_{0.09}$ | Amorphous Phase | 1.21 | 1040 |
| Comparative Example 46 | $Fe_{74.91}B_9P_4Si_6Nb_4Cr_2Cu_{0.09}$ | Amorphous Phase | 1.14 | 1280 |
| Example 190 | $Fe_{73.91}B_{11}P_6Si_7Nb_1Cr_1Cu_{0.09}$ | Amorphous Phase | 1.37 | 940 |
| Example 191 | $Fe_{78.91}B_9P_4Si_6Mo_1Cr_1Cu_{0.09}$ | Amorphous Phase | 1.38 | 1020 |
| Example 192 | $Fe_{78.91}B_9P_4Si_6Ta_1Cr_1Cu_{0.09}$ | Amorphous Phase | 1.37 | 1220 |
| Example 193 | $Fe_{78.91}B_9P_4Si_6W_1Cr_1Cu_{0.09}$ | Amorphous Phase | 1.35 | 1450 |
| Comparative Example 47 | Fe | — | 2.1 | 6320 |
| Comparative Example 48 | $Fe_{88}Si_3Cr_9$ | — | 1.68 | 4900 |

mW/cc. In these cases, a range of 5≦c≦20 defines a condition range for the parameter c of the present invention. In the cases of Comparative Examples 39 and 40 where c=3 and 22, respectively, the capability of forming an amorphous phase was lowered, and soft magnetic powder having an amorphous single phase could not be obtained. Thus, the aforementioned conditions were not met.

Among the compositions listed in Table 7, the compositions of Examples 167-171 and Comparative Examples 41 and 42 correspond to cases where the value d of the P content in $(Fe_{1-a}M^1_a)_{100-b-c-d-e-f-g}M^2_bB_eP_dCu_eM^3_fM^4_g$ is varied from 0 atomic % to 12 atomic %. In the cases of Examples 167-171, powder having an amorphous single phase could be obtained. These cases met conditions of Bs≧1.20 T and Pcv<4900 mW/cc. In these cases, a range of 0.2≦d≦10 defines a condition range for the parameter d of the present invention. In the cases of Comparative Examples 41 and 42 where d=0 and 12, respectively, the capability of forming an amorphous phase was lowered, and soft magnetic powder having an amorphous single phase could not be obtained. Thus, the aforementioned conditions were not met.

Among the compositions listed in Table 7, the compositions of Examples 172-177 and Comparative Examples 43 and 44 correspond to cases where the value e of the Cu content in $(Fe_{1-a}M^1_a)_{100-b-c-d-e-f-g}M^2_bB_cP_dCu_eM^3_fM^4_g$ is varied from 0 atomic % to 1.5 atomic %. In the cases of Examples 172-177, powder having an amorphous single phase could be obtained. These cases met conditions of Bs≧1.20 T and Pcv<4900 mW/cc. In these cases, a range of e≦1 defines a condition range for the parameter e of the present invention. In the cases of Comparative Examples 43 and 44 where e=0 and 1.5, respectively, the capability of forming an amorphous phase was lowered, and soft magnetic powder having an amorphous single phase could not be obtained. Thus, the aforementioned conditions were not met.

Among the compositions listed in Table 7, the compositions of Examples 178-185 and Comparative Example 45 correspond to cases where the value g of the $M^4$ content in $(Fe_{1-a}M^1_a)_{100-b-c-d-e-f-g}M^2_bB_cP_dCu_eM^3_fM^4_g$ is varied from 0 atomic % to 10 atomic %. In the cases of Examples 178-185, powder having an amorphous single phase could be obtained. These cases met conditions of Bs≧1.20 T and Pcv<4900 mW/cc. In these cases, a range of g≦8 defines a condition range for the parameter g of the present invention. In the case of Comparative Examples 45 where g=10, the capability of forming an amorphous phase was lowered, and soft magnetic powder having an amorphous single phase could not be obtained. Thus, the aforementioned conditions were not met.

Among the compositions listed in Table 7, the compositions of Examples 159 and 186-193 and Comparative Example 46 correspond to cases where the value b of the $M^2$ content in $(Fe_{1-a}M^1_a)_{100-b-c-d-e-f-g}M^2_bB_cP_dCu_eM^3_fM^4_g$ is varied from 0 atomic % to 6 atomic %. In the cases of Examples 159 and 186-193, powder having an amorphous single phase could be obtained. These cases met conditions of Bs≧1.20 T and Pcv<4900 mW/cc. In these cases, a range of 0≦b≦5 defines a condition range for the parameter b of the present invention. In the case of Comparative Examples 46 where b=6, the saturation magnetic flux density was lowered, so that the aforementioned conditions were not met.

EXAMPLES 194-242 AND COMPARATIVE EXAMPLES 49-62

Materials of Fe, B, $Fe_{75}P_{25}$, Si, C, Al, Cu, Nb, Mo, Cr, Ta, Cr, Hf, Y, and Pd were respectively weighed so as to provide alloy compositions of Examples 194-242 of the present invention and Comparative Examples 49-62 as listed in Tables 8-1 and 8-2 below (hereinafter collectively referred to as Table 8) and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a water atomization method so as to produce soft magnetic powders having an average grain diameter of 10 μm. Measurement was performed on the powders by an X-ray diffraction method to determine a phase. FIG. 1 shows, as a profile example, an X-ray diffraction profile of a soft magnetic powder prior to heat treatment that was prepared with the composition of $Fe_{79.91}B_{10}P_2Si_2Nb_5Cr_1Cu_{0.09}$, which is included in the present invention. The example as shown in FIG. 1 only had a broad peak and was determined to be in an "amorphous phase." For powders of a fully amorphous single phase, the saturation magnetic flux density Bs was evaluated by VSM. No evaluation was made on the soft magnetic powders that had a low capability of forming an amorphous phase and deposited crystals thereon. Next, each of the powders prior to heat treatment was mixed and granulated with a solution of silicone resin such that a weight ratio of the soft magnetic powder and the solid content of the silicone resin was 100/5. Press forming was conducted on the granulated powders under a forming pressure of 1000 MPa so as to produce molded bodies (dust cores) having a toroidal shape with an outside diameter of 18 mm, an inside diameter of 12 mm, and a thickness of 3 mm. Then heat treatment was performed on each molded body to harden the silicone resin as a binder, thereby producing dust cores for evaluation. Furthermore, forming and heat treatment were conducted under the same conditions on the powder having the Fe composition and the powder having the $Fe_{88}Si_3Cr_9$ composition produced by water atomization, as conventional materials, thereby producing dust cores for evaluation. The core loss of those dust cores was measured under excitation conditions of 100 kHz and 100 mT with use of an alternating current BH analyzer. At that time, heat treatment was performed on each sample at a temperature of 600° C. for 10 minutes to deposit nanocrystals. Furthermore, heat treatment was performed on the Fe powder at 500° C. for 60 minutes and on the $Fe_{88}Si_3Cr_9$ powder at 700° C. for 60 minutes to deposit nanocrystals. Table 8 shows the measurement results of the X-ray diffraction results, the saturation magnetic flux density Bs, the core loss Pcv after heat treatment with regard to the powders having the amorphous alloy compositions according to Examples 194-242 of the present invention and Comparative Examples 49-62.

TABLE 8

| | Alloy Composition (at %) | X-ray Diffraction Results | Bs (T) | Pcv (mW/cc) |
|---|---|---|---|---|
| Comparative Example 49 | $Fe_{80.91}B_4P_3Si_6Nb_5Cr_1Cu_{0.09}$ | Crystal Phase | — | — |
| Example 194 | $Fe_{79.91}B_5P_3Si_6Nb_5Cr_1Cu_{0.09}$ | Amorphous Phase | 1.47 | 2410 |

TABLE 8-continued

| | Alloy Composition (at %) | X-ray Diffraction Results | Bs (T) | Pcv (mW/cc) |
|---|---|---|---|---|
| Example 195 | $Fe_{79.91}B_8P_3Si_3Nb_5Cr_1Cu_{0.09}$ | Amorphous Phase | 1.46 | 1120 |
| Example 196 | $Fe_{79.91}B_{10}P_2Si_2Nb_5Cr_1Cu_{0.09}$ | Amorphous Phase | 1.51 | 820 |
| Example 197 | $Fe_{80.91}B_{10}P_2Si_2Nb_5Cu_{0.09}$ | Amorphous Phase | 1.56 | 930 |
| Example 198 | $Fe_{79.91}B_{12}P_3Nb_5Cu_{0.09}$ | Amorphous Phase | 1.48 | 1210 |
| Example 199 | $Fe_{75.6}B_{15}P_2Si_2Nb_5Cu_{0.4}$ | Amorphous Phase | 1.42 | 2200 |
| Example 200 | $Fe_{74.6}B_{18}P_1Si_1Nb_5Cu_{0.4}$ | Amorphous Phase | 1.38 | 3210 |
| Comparative Example 50 | $Fe_{73.2}B_{20}P_1Nb_5Cu_{0.8}$ | Crystal Phase | — | — |
| Comparative Example 51 | $Fe_{80.91}B_{14}Nb_5Cu_{0.09}$ | Crystal Phase | — | — |
| Example 201 | $Fe_{79.71}B_{13}P_{0.2}Si_1Nb_5Cr_1Cu_{0.09}$ | Amorphous Phase | 1.49 | 1440 |
| Example 202 | $Fe_{79.91}B_{12}P_1Si_1Nb_5Cr_1Cu_{0.09}$ | Amorphous Phase | 1.51 | 1090 |
| Example 203 | $Fe_{81.91}B_{12}P_1Nb_5Cu_{0.09}$ | Amorphous Phase | 1.55 | 1410 |
| Example 204 | $Fe_{79.91}B_{11}P_1Si_2Nb_5Cr_1Cu_{0.09}$ | Amorphous Phase | 1.48 | 1000 |
| Example 205 | $Fe_{79.91}B_8P_4Si_2Nb_5Cr_1Cu_{0.09}$ | Amorphous Phase | 1.48 | 1420 |
| Example 206 | $Fe_{78.91}B_8P_5Si_2Nb_5Cr_1Cu_{0.09}$ | Amorphous Phase | 1.45 | 1670 |
| Example 207 | $Fe_{76.91}B_7P_8Si_2Nb_5Cr_1Cu_{0.09}$ | Amorphous Phase | 1.41 | 4300 |
| Comparative Example 52 | $Fe_{75.91}B_6P_{10}Si_2Nb_5Cr_1Cu_{0.09}$ | Amorphous Phase | 1.41 | 5250 |
| Comparative Example 53 | $Fe_{80}B_{10}P_2Si_2Nb_5Cr_1$ | Crystal Phase | — | — |
| Example 208 | $Fe_{79.975}B_{10}P_2Si_2Nb_5Cr_1Cu_{0.025}$ | Amorphous Phase | 1.49 | 2650 |
| Example 209 | $Fe_{79.95}B_{10}P_2Si_2Nb_5Cr_1Cu_{0.05}$ | Amorphous Phase | 1.50 | 1490 |
| Example 210 | $Fe_{80.91}B_{10}P_2Si_2Nb_5Cu_{0.09}$ | Amorphous Phase | 1.56 | 930 |
| Example 211 | $Fe_{79.7}B_{10}P_2Si_2Nb_5Cr_1Cu_{0.3}$ | Amorphous Phase | 1.48 | 1230 |
| Example 212 | $Fe_{79.5}B_{12}P_3Nb_5Cu_{0.5}$ | Amorphous Phase | 1.56 | 1270 |
| Example 213 | $Fe_{79.4}B_{10}P_2Si_2Nb_5Cr_1Cu_{0.6}$ | Amorphous Phase | 1.47 | 1330 |
| Example 214 | $Fe_{76}B_8P_2Si_7Nb_5Cr_1Cu_1$ | Amorphous Phase | 1.44 | 1430 |
| Comparative Example 54 | $Fe_{75.5}B_{12}P_2Nb_5Cr_1Cu_{1.5}$ | Crystal Phase | — | — |
| Example 215 | $Fe_{79.91}B_{12}P_2Nb_5Cr_1Cu_{0.09}$ | Amorphous Phase | 1.50 | 1320 |
| Example 216 | $Fe_{79.91}B_{10}P_4Nb_5Cr_1Cu_{0.09}$ | Amorphous Phase | 1.51 | 1100 |
| Example 217 | $Fe_{79.91}B_8P_6Nb_5Cr_1Cu_{0.09}$ | Amorphous Phase | 1.53 | 1810 |
| Example 218 | $Fe_{79.91}B_{10}P_2Si_2Nb_5Cr_1Cu_{0.09}$ | Amorphous Phase | 1.51 | 820 |
| Example 219 | $Fe_{79.91}B_{11}P_2Si_1Nb_5Cr_1Cu_{0.09}$ | Amorphous Phase | 1.52 | 910 |
| Example 220 | $Fe_{79.91}B_8P_4Si_2Nb_5Cr_1Cu_{0.09}$ | Amorphous Phase | 1.51 | 980 |
| Example 221 | $Fe_{79.91}B_9P_1Si_4Nb_5Cr_1Cu_{0.09}$ | Amorphous Phase | 1.46 | 1020 |
| Example 222 | $Fe_{79.91}B_{11}P_{0.5}Si_{2.5}Nb_5Cr_1Cu_{0.09}$ | Amorphous Phase | 1.47 | 1090 |
| Example 223 | $Fe_{79.91}B_9P_2Si_2C_1Nb_5Cr_1Cu_{0.09}$ | Amorphous Phase | 1.49 | 1320 |
| Example 224 | $Fe_{78.91}B_7P_2Si_4C_2Nb_5Cr_1Cu_{0.09}$ | Amorphous Phase | 1.49 | 1290 |
| Example 225 | $Fe_{78.91}B_7P_2Si_6Nb_5Cr_1Cu_{0.09}$ | Amorphous Phase | 1.44 | 1720 |
| Example 226 | $Fe_{77.91}B_6P_2Si_8Nb_5Cr_1Cu_{0.09}$ | Amorphous Phase | 1.44 | 1560 |
| Example 227 | $Fe_{74.4}B_9P_2Si_8Nb_5Cr_1Cu_{0.6}$ | Amorphous Phase | 1.36 | 1210 |
| Comparative Example 55 | $Fe_{77.91}B_5P_1Si_{10}Nb_5Cr_1Cu_{0.09}$ | Crystal Phase | — | — |
| Example 228 | $Fe_{79.91}B_{10}P_2Si_3Al_1Nb_5Cr_1Cu_{0.09}$ | Amorphous Phase | 1.47 | 1440 |
| Comparative Example 56 | $Fe_{79.91}B_{11}P_4Si_5Cu_{0.09}$ | Amorphous Phase | 1.67 | 7700 |
| Example 229 | $Fe_{79.6}B_{10}P_4Si_5Nb_1Cu_{0.4}$ | Amorphous Phase | 1.63 | 2470 |
| Example 230 | $Fe_{79.6}B_{10}P_3Si_4Nb_2Cr_1Cu_{0.4}$ | Amorphous Phase | 1.60 | 1820 |
| Example 231 | $Fe_{79.91}B_{10}P_2Si_3Nb_4Cr_1Cu_{0.09}$ | Amorphous Phase | 1.57 | 1420 |
| Example 232 | $Fe_{80.91}B_{10}P_2Si_2Nb_5Cu_{0.09}$ | Amorphous Phase | 1.56 | 930 |
| Example 233 | $Fe_{78.91}B_{10}P_2Si_2Nb_5Cr_2Cu_{0.09}$ | Amorphous Phase | 1.47 | 1270 |
| Example 234 | $Fe_{75.91}B_{10}P_2Si_2Nb_6Cr_4Cu_{0.09}$ | Amorphous Phase | 1.31 | 2380 |
| Comparative Example 57 | $Fe_{73.91}B_{10}P_2Si_2Nb_6Cr_6Cu_{0.09}$ | Amorphous Phase | 1.17 | 4250 |
| Example 235 | $Fe_{79.91}B_{12}P_3Nb_4Mo_1Cu_{0.09}$ | Amorphous Phase | 1.55 | 1050 |
| Example 236 | $Fe_{79.91}B_{12}P_3Nb_4Zr_1Cu_{0.09}$ | Amorphous Phase | 1.57 | 1810 |
| Example 237 | $Fe_{79.91}B_{12}P_3Nb_4Ta_1Cu_{0.09}$ | Amorphous Phase | 1.53 | 1770 |
| Example 238 | $Fe_{79.91}B_{12}P_3Nb_4Hf_1Cu_{0.09}$ | Amorphous Phase | 1.56 | 1180 |
| Example 239 | $Fe_{79.91}B_{12}P_3Nb_4Cr_1Cu_{0.09}$ | Amorphous Phase | 1.55 | 1530 |
| Example 240 | $Fe_{78.91}B_{12}P_3Nb_5Cu_{0.09}Pd_1$ | Amorphous Phase | 1.54 | 1240 |
| Example 241 | $Fe_{77.91}B_{12}P_3Nb_5Cu_{0.09}Pd_2$ | Amorphous Phase | 1.50 | 3800 |
| Comparative Example 58 | $Fe_{76.91}B_{12}P_3Nb_5Cu_{0.09}Pd_3$ | Crystal Phase | — | — |
| Example 242 | $Fe_{78.91}B_{12}P_3Nb_5Cu_{0.09}Y_1$ | Amorphous Phase | 1.56 | 1110 |
| Comparative Example 59 | $Fe_{73.5}Si_{13.5}B_9Nb_3Cu_1$ | Crystal Phase | — | — |
| Comparative Example 60 | $Fe_{85}B_9Nb_6$ | Crystal Phase | — | — |
| Comparative Example 61 | Fe | | 2.15 | 6320 |
| Comparative Example 62 | $Fe_{88}Si_3Cr_9$ | | 1.68 | 4900 |

As shown in Table 8, each of the amorphous alloy compositions of Examples 194-242 could produce powder of an amorphous single phase having an average grain diameter of 10 μm by a water atomization method. Each of the amorphous alloy compositions had a saturation magnetic flux density Bs of at least 1.30 T and had a core loss Pcv less than 4900 mW/cc.

Among the compositions listed in Table 8, the compositions of Examples 194-200 and Comparative Examples 49 and 50 correspond to cases where the value c of the B content in $(Fe_{1-a}M^1{}_a)_{100-b-c-d-e-f-g}M^2{}_bB_cP_dCu_eM^3{}_fM^4{}_g$ is varied from 4 atomic % to 20 atomic %. In the cases of Examples 194-200, powder having an amorphous single phase could be obtained. These cases met conditions of Bs≧1.30 T and Pcv<4900 mW/cc after the heat treatment. In these cases, a range of c≦18 defines a condition range for the parameter c of the present invention. In the cases of Comparative Examples 49 and 50 where c=4 and 20, respectively, the capability of forming an amorphous phase was lowered, and powder having an amorphous single phase could not be obtained. Thus, the aforementioned conditions were not met.

Among the compositions listed in Table 8, the compositions of Examples 201-207 and Comparative Examples 51 and 52 correspond to cases where the value d of the P content in $(Fe_{1-a}M^1{}_a)_{100-b-c-d-e-f-g}M^2{}_bB_cP_dCu_eM^3{}_fM^4{}_g$ is varied from 0 atomic % to 10 atomic %. In the cases of Examples 201-207, powder having an amorphous single phase could be obtained. These cases met conditions of Bs≧1.30 T and Pcv<4900 mW/cc after the heat treatment. In these cases, a range of 0.2≦d≦8 defines a condition range for the parameter d of the present invention. In the case of Comparative Example 51 where d=0, the capability of forming an amorphous phase was lowered, and powder having an amorphous single phase could not be obtained. In the case of Comparative Example 52 where d=10, the core loss Pcv was lowered because the P content was excessive. Thus, the aforementioned conditions were not met in those comparative examples. Moreover, it is preferable to maintain the P content at 5 atomic % or less in order to further reduce the core loss Pcv.

Among the compositions listed in Table 8, the compositions of Examples 208-214 and Comparative Examples 53 and 54 correspond to cases where the value e of the Cu content in $(Fe_{1-a}M^1{}_a)_{100-b-c-d-e-f-g}M^2{}_bB_cP_dCu_eM^3{}_fM^4{}_g$ is varied from 0 atomic % to 1.5 atomic %. In the cases of Examples 208-214, powder having an amorphous single phase could be obtained. These cases met conditions of Bs≧1.30 T and Pcv<4900 mW/cc after the heat treatment. In these cases, a range of 0.025≦e≦1.0 defines a condition range for the parameter e of the present invention. In the cases of Comparative Examples 53 and 54 where e=0 and 1.5, respectively, the capability of forming an amorphous phase was lowered, and powder having an amorphous single phase could not be obtained. Thus, the aforementioned conditions were not met.

Among the compositions listed in Table 8, the compositions of Examples 215-228 and Comparative Example 55 correspond to cases where the value g of the $M^4$ content in $(Fe_{1-a}M^1{}_a)_{100-b-c-d-e-f-g}M^2{}_bB_cP_dCu_eM^3{}_fM^4{}_g$ is varied from 0 atomic % to 10 atomic %. In the cases of Examples 215-228, powder having an amorphous single phase could be obtained. These cases met conditions of Bs≧1.30 T and Pcv<4900 mW/cc after the heat treatment. In these cases, a range of 0≦g≦8 defines a condition range for the parameter g of the present invention. In the case of Comparative Example 55 where g=10, the capability of forming an amorphous phase was lowered, and powder having an amorphous single phase could not be obtained. Thus, the aforementioned conditions were not met.

Among the compositions listed in Table 8, the compositions of Examples 229-239 and Comparative Examples 56 and 57 correspond to cases where the value b of the $M^2$ content in $(Fe_{1-a}M^1{}_a)_{100-b-c-d-e-f-g}M^2{}_bB_cP_dCu_eM^3{}_fM^4{}_g$ is varied from 0 atomic % to 12 atomic %. In the cases of Examples 229-239, powder having an amorphous single phase could be obtained. These cases met conditions of Bs≧1.30 T and Pcv<4900 mW/cc after the heat treatment. In these cases, a range of 1≦b≦10 defines a condition range for the parameter b of the present invention. In the case of Comparative Example 56 where b=0, the core loss Pcv was also lowered. In the case of Comparative Example 57 where b=12, the saturation magnetic flux density Bs was lowered because the Nb-content was excessive, and the core loss Pcv was also lowered. Thus, the aforementioned conditions were not met in those comparative examples.

Among the compositions listed in Table 8, the compositions of Examples 240-242 and Comparative Example 58 correspond to cases where the value f of the $M^3$ content in $(Fe_{1-a}M^1{}_a)_{100-b-c-d-e-f-g}M^2{}_bB_cP_dCu_eM^3{}_fM^4{}_g$ is varied from 0 atomic % to 3 atomic %. In the cases of Examples 240-242, powder having an amorphous single phase could be obtained. These cases met conditions of Bs≧1.30 T and Pcv<4900 mW/cc after the heat treatment. In these cases, a range of 0≦f≦2 defines a condition range for the parameter f of the present invention. In the case of Comparative Example 58 where f=3, the capability of forming an amorphous phase was lowered, and powder having an amorphous single phase could not be obtained. Thus, the aforementioned conditions were not met.

EXAMPLES 243-251 AND COMPARATIVE EXAMPLE 63

Materials of Fe, B, $Fe_{75}P_{25}$, Si, $Fe_{80}C_{20}$, Al, Cu, Nb, and Cr were respectively weighed so as to provide alloy compositions of Examples 243-251 of the present invention and Comparative Example 63 as listed in Table 9 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having a thickness of about 30 μM, a width of about 5 mm, and a length of about 5 m. A surface of each ribbon was evaluated by an X-ray diffraction method to determine whether to have an amorphous single phase. Furthermore, the saturation magnetic flux density Bs was evaluated by VSM. Moreover, each continuous ribbon was cut into a length of about 3 cm, which was subjected to a constant-temperature high-humidity test under conditions of 60° C. and 95% RH. The discoloration on a surface of the ribbon was evaluated after 24 hours and after 100 hours, respectively. Furthermore, the master alloys were processed by a water atomization method so as to produce soft magnetic powders having an average grain diameter of 10 μm. The surface condition of each powder was observed after the water atomization. Furthermore, measurement using an X-ray diffraction method was performed to examine whether to have an amorphous single phase. Table 9 shows the observation results of the saturation magnetic flux density Bs, the surface condition after the constant-temperature high-humidity test of the ribbons, the surface condition after the atomization of the powders with regard to the compositions according to Examples 243-251 of the present invention and Comparative Example 63.

TABLE 9

| | Alloy Composition (at %) | Bs (T) | Surface Condition of Ribbon After 24 Hours From Constant-temperature High-humidity Test | Surface Condition of Ribbon After 100 Hours From Constant-temperature High-humidity Test | Surface Condition of Powder After Atomization |
|---|---|---|---|---|---|
| Example 243 | $Fe_{77.91}B_{10}P_5Si_7Cu_{0.09}$ | 1.56 | Discolored | Discolored | Discolored |
| Example 244 | $Fe_{77.81}B_{10}P_5Si_7Cr_{0.1}Cu_{0.09}$ | 1.55 | No Discoloration | Discolored | No Discoloration |
| Example 245 | $Fe_{76.91}B_{10}P_5Si_7Cr_1Cu_{0.09}$ | 1.46 | No Discoloration | No Discoloration | No Discoloration |
| Example 246 | $Fe_{74.91}B_{11}P_5Si_6Cr_3Cu_{0.09}$ | 1.33 | No Discoloration | No Discoloration | No Discoloration |
| Example 247 | $Fe_{72.91}B_{12}P_5Si_5Cr_5Cu_{0.09}$ | 1.23 | No Discoloration | No Discoloration | No Discoloration |
| Comparative Example 63 | $Fe_{70.91}B_{12}P_5Si_5Cr_7Cu_{0.09}$ | 1.01 | No Discoloration | No Discoloration | No Discoloration |
| Example 248 | $Fe_{75.91}B_{11}P_5Si_7Cr_1Cu_{0.09}$ | 1.42 | No Discoloration | No Discoloration | No Discoloration |
| Example 249 | $Fe_{75.91}B_{11}P_5Si_5C_2Cr_1Cu_{0.09}$ | 1.31 | No Discoloration | No Discoloration | No Discoloration |
| Example 250 | $Fe_{78.91}B_9P_3Si_7Nb_1Cr_1Cu_{0.09}$ | 1.39 | No Discoloration | No Discoloration | No Discoloration |
| Example 251 | $Fe_{78.91}B_9P_3Si_7Al_1Cr_1Cu_{0.09}$ | 1.49 | No Discoloration | No Discoloration | No Discoloration |

As shown in Table 9, each of the amorphous alloy compositions of Examples 243-251 could produce a continuous ribbon of an amorphous single phase having a thickness of 30 μm by a single-roll liquid quenching method and produce powder of an amorphous single phase having an average grain diameter of 10 μm by a water atomization method. Each of the amorphous alloy compositions had a saturation magnetic flux density Bs of at least 1.20 T. Furthermore, Comparative Example 63 had a saturation magnetic flux density Bs less than 1.20 T because of an excessive addition of Cr. The corrosion resistance was evaluated for Examples 243-251 and Comparative Example 63. As a result, Example 243, which contained no Cr, discolored the ribbon after the constant-temperature high-humidity test, and discolored the powder after the atomization, had an unchanged magnetic property but was not preferable in appearance. It is preferable to contain Cr of at least 0.1 atomic %, more preferably at least 1 atomic %. Furthermore, in Comparative Example 63 where the $M^2$ content was more than 5 atomic %, the saturation magnetic flux density Bs was less than 1.20 T, so that the aforementioned conditions were not met.

EXAMPLES 252-258 AND COMPARATIVE EXAMPLE 64

Materials of Fe, B, $Fe_{75}P_{25}$, Si, $Fe_{80}C_{20}$, Cu, Nb, and Cr were respectively weighed so as to provide alloy compositions of Examples 252-258 of the present invention and Comparative Example 64 as listed in Table 10 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having a thickness of about 30 μM, a width of about 5 mm, and a length of about 5 m. Furthermore, heat treatment was performed at a temperature of 60° C. within an Ar atmosphere for 5 minutes, thereby depositing nanocrystals. For each ribbon, the saturation magnetic flux density Bs was evaluated by VSM. Moreover, a constant-temperature high-humidity test was performed under conditions of 60° C. and 95% RH. The discoloration on a surface of the ribbon was evaluated after 24 hours and after 100 hours, respectively. Furthermore, the master alloys were processed by a water atomization method so as to produce soft magnetic powders having an average grain diameter of 10 μm. The surface condition of each powder was observed after the water atomization. Furthermore, measurement using an X-ray diffraction method was performed to examine whether to have an amorphous single phase. Table 10 shows the observation results of the saturation magnetic flux density Bs, the surface condition after the constant-temperature high-humidity test of the ribbons, the surface condition after the atomization of the powders with regard to the compositions according to Examples 252-258 of the present invention and Comparative Example 64.

TABLE 10

| | Alloy Composition (at %) | Bs (T) | Surface Condition of Ribbon After 24 Hours From Constant-temperature High-humidity Test | Surface Condition of Ribbon After 100 Hours From Constant-temperature High-humidity Test | Surface Condition of Powder After Atomization |
|---|---|---|---|---|---|
| Example 252 | $Fe_{80.91}B_{10}P_2Si_2Nb_5Cu_{0.09}$ | 1.59 | Discolored | Discolored | Discolored |
| Example 253 | $Fe_{80.81}B_{10}P_2Si_2Nb_5Cr_{0.1}Cu_{0.09}$ | 1.57 | No Discoloration | Discolored | No Discoloration |
| Example 254 | $Fe_{79.91}B_{10}P_2Si_2Nb_5Cr_1Cu_{0.09}$ | 1.52 | No Discoloration | No Discoloration | No Discoloration |
| Example 255 | $Fe_{77.91}B_{10}P_2Si_2Nb_5Cr_3Cu_{0.09}$ | 1.39 | No Discoloration | No Discoloration | No Discoloration |
| Example 256 | $Fe_{75.91}B_{10}P_2Si_2Nb_5Cr_5Cu_{0.09}$ | 1.30 | No Discoloration | No Discoloration | No Discoloration |
| Comparative Example 64 | $Fe_{73.91}B_{10}P_2Si_2Nb_6Cr_6Cu_{0.09}$ | 1.22 | No Discoloration | No Discoloration | No Discoloration |
| Example 257 | $Fe_{79.91}B_{11}P_3Nb_5Cr_1Cu_{0.09}$ | 1.51 | No Discoloration | No Discoloration | No Discoloration |
| Example 258 | $Fe_{80.41}B_7P_2Si_4C_{0.5}Nb_5Cr_1Cu_{0.09}$ | 1.53 | No Discoloration | No Discoloration | No Discoloration |

As shown in Table 10, each of the amorphous alloy compositions of Examples 252-258 could produce a continuous ribbon of an amorphous single phase having a thickness of 30 μm by a single-roll liquid quenching method and produce powder of an amorphous single phase having an average grain diameter of 10 μm by a water atomization method. Each of the amorphous alloy compositions had a saturation magnetic flux density Bs of at least 1.30 T. Furthermore, Comparative Example 64 had a saturation magnetic flux density Bs less than 1.30 T because of an excessive addition of Cr. The corrosion resistance was evaluated for Examples 252-258 and Comparative Example 64. As a result, Example 252, which contained no Cr, had an unchanged magnetic property but was not preferable in appearance. It is preferable to contain Cr of 0.1 atomic % or more, more preferably at least 1 atomic %. Furthermore, in Comparative Example 64 where the $M^2$ content was more than 12 atomic %, the saturation magnetic flux density Bs was less than 1.30 T, so that the aforementioned conditions were not met.

EXAMPLES 259-266

Materials of Fe, B, $Fe_{75}P_{25}$, Si, $Fe_{80}C_{20}$, Cu, Nb, and Cr were respectively weighed so as to provide alloy compositions of Examples 259-266 of the present invention as listed in Table 11 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a single-roll liquid quenching method so as to produce continuous ribbons having a thickness of 25 μM, a width of about 5 mm, and a length of about 10 m. For each ribbon, the resistivity was evaluated with a resistance meter. Furthermore, the ribbons were used to produce a wound magnetic core having an inside diameter of 15 mm, an outside diameter of 25 mm, and a height of 5 mm. The initial magnetic permeability was evaluated at 10 kHz and 100 kHz, respectively, with an impedance analyzer. Furthermore, heat treatment was performed on each sample of Examples 259-262 at a temperature of 400° C. within an Ar atmosphere for 60 minutes to reduce internal stress. Heat treatment was performed on each sample of Examples 263-266 at a temperature of 600° C. within an Ar atmosphere for 5 minutes to deposit nanocrystals. Table 11 shows the evaluation results of the resistivity, the initial magnetic permeabilities at 10 kHz and 100 kHz, and the reduction ratio of the initial magnetic permeability in increasing the frequency from 10 kHz to 100 kHz with regard to the soft magnetic alloys having the compositions according to Examples 259-266 of the present invention.

TABLE 11

| | Alloy Composition (at %) | Resistivity (μΩcm) | Initial Magnetic Permeability 10 kHz | Initial Magnetic Permeability 100 kHz | Reduction Ratio |
|---|---|---|---|---|---|
| Example 259 | $Fe_{77.91}B_{10}P_5Si_7Cu_{0.09}$ | 127 | 12000 | 5900 | 51% |
| Example 260 | $Fe_{77.81}B_{10}P_5Si_7Cr_{0.1}Cu_{0.09}$ | 148 | 11800 | 7900 | 33% |
| Example 261 | $Fe_{76.91}B_{10}P_5Si_7Cr_1Cu_{0.09}$ | 151 | 12100 | 8200 | 32% |
| Example 262 | $Fe_{74.91}B_{11}P_5Si_6Cr_3Cu_{0.09}$ | 152 | 11200 | 8000 | 29% |
| Example 263 | $Fe_{80.91}B_{10}P_2Si_2Nb_5Cu_{0.09}$ | 119 | 32000 | 14500 | 55% |
| Example 264 | $Fe_{80.81}B_{10}P_2Si_2Nb_5Cr_{0.1}Cu_{0.09}$ | 140 | 31000 | 18900 | 39% |
| Example 265 | $Fe_{79.91}B_{10}P_2Si_2Nb_5Cr_1Cu_{0.09}$ | 140 | 28000 | 17400 | 38% |
| Example 266 | $Fe_{77.91}B_{10}P_2Si_2Nb_5Cr_3Cu_{0.09}$ | 144 | 34500 | 21400 | 38% |

When the resistivity and the initial magnetic permeability of Examples 259-266 as shown in Table 11 were evaluated, Examples 259 and 263, which did not contain Cr, had a resistivity lower than those of the compositions containing Cr. Furthermore, the reduction ratio of the initial magnetic permeability was as high as at least 50% in the high-frequency region. Accordingly, it is preferable to contain Cr of at least 0.1 atomic %.

EXAMPLES 267-277 AND COMPARATIVE EXAMPLES 65-76

Materials of Fe, B, $Fe_{75}P_{25}$, Si, Cu, Nb, and Cr were respectively weighed so as to provide $Fe_{73.91}B_{11}P_6Si_7Nb_1Cr_1Cu_{0.09}$, $Fe_{79.91}B_{12}P_3Nb_5Cu_{0.09}$, and $Fe_{79.91}B_{10}P_2Si_2Nb_5Cr_1Cu_{0.09}$, respectively, and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a water atomization method so as to produce soft magnetic powders having an average grain diameter of 10 μm. Measurement using an X-ray diffraction method was performed on the powders to examine whether to have an amorphous single phase. Next, each of the powders prior to heat treatment was mixed and granulated with a solution of silicone resin such that a weight ratio of the soft magnetic powder and the solid content of the silicone resin was 100/5. Press forming was conducted on the granulated powders under a forming pressure of 1000 MPa so as to produce molded bodies (dust cores) having a toroidal shape with an outside diameter of 18 mm, an inside diameter of 12 mm, and a thickness of 3 mm. Then heat treatment was performed on each molded body to harden the silicone resin as a binder, thereby producing dust cores for evaluation. Moreover, heat treatment was performed on the powders and the produced dust cores at temperatures of 200° C., 300° C., 400° C., 500° C., 600° C., 700° C., and 800° C., respectively. Periods of the heat treatment were 60 minutes for the composition of $Fe_{73.91}B_{11}P_6Si_7Nb\ Cr_1Cu_{0.09}$ and 10 minutes for the compositions of $Fe_{79.91}B_{12}P_3Nb_sCu_{0.09}$ and $Fe_{79.91}B_{10}P_2Si_2Nb_5Cr_1Cu_{0.09}$. Thus, samples for evaluation were produced. Furthermore, forming was conducted under the same conditions on the powder having the Fe composition and the powder having the $Fe_{88}Si_3Cr_9$ composition produced by water atomization, as conventional materials. Heat treatment was performed on the Fe powder at a temperature of 500° C. for 60 minutes and on the $Fe_{88}Si_3Cr_9$ powder at a temperature of 700° C. for 60 minutes. Next, measurement using an X-ray diffraction method was performed on the powders subjected to heat treatment. The crystal grain diameter of deposited nanocrystals was calculated from the half-widths of the resultant X-ray diffraction peaks by using the Scherrer's equation. The saturation magnetic flux density Bs was evaluated by VSM. Furthermore, the core loss of the dust core samples was measured under excitation conditions of 100 kHz and 100 mT with use of a BH analyzer. Table 12 show the measurement results of the saturation magnetic flux density Bs, the average crystal grain diameter of the powders, the core loss Pcv of the dust cores with regard to the amorphous alloy compositions according to Examples 267-277 of the present invention and Comparative Examples 65-76 for each heat treatment condition.

TABLE 12

| | Alloy Composition (at %) | Heat Treatment Temperature (° C.) | Bs (T) | Average Crystal Grain Diameter (nm) | Pcv (mW/cc) |
|---|---|---|---|---|---|
| Comparative Example 65 | $Fe_{73.91}B_{11}P_6Si_7Nb_1Cr_1Cu_{0.09}$ | 200 | 1.35 | Amorphous Phase | 5050 |
| Example 267 | | 300 | 1.35 | Amorphous Phase | 1400 |
| Example 268 | | 400 | 1.36 | Amorphous Phase | 1020 |
| Example 269 | | 500 | 1.35 | Amorphous Phase | 1230 |
| Example 270 | | 600 | 1.36 | Amorphous Phase | 3780 |
| Comparative Example 66 | | 700 | 1.48 | 190 | ≧10000 |
| Comparative Example 67 | | 800 | 1.49 | 200 | ≧10000 |
| Comparative Example 68 | $Fe_{79.91}B_{12}P_3Nb_5Cu_{0.09}$ | 200 | 0.92 | Amorphous Phase | 4200 |
| Comparative Example 69 | | 300 | 0.92 | Amorphous Phase | 4600 |
| Comparative Example 70 | | 400 | 1.02 | Amorphous Phase | 1200 |
| Example 271 | | 500 | 1.46 | 14 | 1420 |
| Example 272 | | 600 | 1.56 | 17 | 1000 |
| Example 273 | | 700 | 1.62 | 35 | 1520 |
| Comparative Example 71 | | 800 | 1.63 | 200 | ≧10000 |
| Comparative Example 72 | $Fe_{79.91}B_{10}P_2Si_2Nb_5Cr_1Cu_{0.09}$ | 200 | 0.88 | Amorphous Phase | 4100 |
| Comparative Example 73 | | 300 | 0.89 | Amorphous Phase | 4440 |
| Example 274 | | 400 | 1.31 | 12 | 1150 |
| Example 275 | | 500 | 1.42 | 12 | 1200 |
| Example 276 | | 600 | 1.51 | 13 | 820 |
| Example 277 | | 700 | 1.58 | 50 | 1480 |
| Comparative | | 800 | 1.63 | 220 | ≧10000 |

TABLE 12-continued

| | Alloy Composition (at %) | Heat Treatment Temperature (° C.) | Bs (T) | Average Crystal Grain Diameter (nm) | Pcv (mW/cc) |
|---|---|---|---|---|---|
| Example 74 | | | | | |
| Comparative Example 75 | Fe | — | 2.15 | — | 6320 |
| Comparative Example 76 | $Fe_{88}Si_3Cr_9$ | — | 1.68 | — | 4900 |

As shown in Table 12, each of the amorphous alloy compositions of Examples 267-270 had a saturation magnetic flux density Bs of at least 1.20 T. Furthermore, the nanocrystalline compositions of Examples 271-277 could have a saturation magnetic flux density Bs of at least 1.30 T and a core loss Pcv lower than 4900 mW/cc by performing proper heat treatment.

Heat treatment conditions of the $Fe_{73.91}B_{11}P_6Si_7NbCr_1Cu_{0.09}$ composition in Examples 267-270 and Comparative Examples 65-67 of Table 12 correspond to heat treatment temperatures from 200° C. to 800° C. Examples 267-270 met conditions of Bs≧1.20 T and Pcv<4900 mW/cc after the heat treatment. Preferable heat treatment conditions for alloy compositions having an amorphous phase of the present invention are in a range of 600° C. or less. Comparative Example 65 where the heat treatment temperature was 200° C. could not reduce internal stress applied at the time of formation because the heat treatment temperature was low. Therefore, the core loss Pcv was lowered. Furthermore, with the compositions of Comparative Examples 66 and 67 where the heat treatment condition was 700° C. to 800° C., deposited crystals were bulked because the heat treatment condition was not lower than the crystallization temperature. Therefore, the core loss Pcv was lowered. Thus, the aforementioned conditions were not met in those comparative examples.

Heat treatment conditions of the $Fe_{79.91}B_{12}P_3Nb_5Cu_{0.09}$ composition and the $Fe_{79.91}B_{10}P_2Si_2Nb_5Cr_1Cu_{0.09}$ composition in Examples 271-277 and Comparative Examples 68-74 listed in Table 12 correspond to heat treatment temperatures from 200° C. to 800° C. Examples 271-277 met conditions of Bs≧1.30 T and Pcv<4900 mW/cc after the heat treatment. Preferable heat treatment conditions for alloy compositions of the present invention for depositing nanocrystals from an amorphous phase by heat treatment are in a range of from 400° C. to 700° C. In Comparative Examples 68-70, 72, and 73 where the heat treatment temperature was low, the saturation magnetic flux density Bs was low because no nanocrystals were deposited. Furthermore, in Comparative Examples 71 and 74 where the heat treatment condition was 800° C., crystals were bulked because the heat treatment temperature was high. Therefore, core loss Pcv was lowered. Thus, the aforementioned conditions were not met in those comparative examples.

Examples 267-277 and Comparative Examples 65-74 listed in Table 12 correspond to average crystal grain diameters up to 220 nm Examples 267-277 met conditions of Bs≧1.30 T and Pcv<4900 mW/cc after the heat treatment. The average crystal grain diameter for alloy compositions of the present invention for depositing nanocrystals from an amorphous phase by heat treatment is in a range of 50 nm. In the cases of Comparative Examples 66, 67, 71, and 74 where the average crystal grain diameter was greater than 50 nm, the core loss Pcv was lowered, so that the aforementioned conditions were not met.

EXAMPLES 278-287 AND COMPARATIVE EXAMPLES 77-80

Materials of Fe, Si, B, $Fe_{75}P_{25}$, Cu, Nb, and Cr were respectively weighed so as to provide $Fe_{73.91}B_{11}P_6Si_7Nb_1Cr_1Cu_{0.09}$ and $Fe_{79.9}Si_2B_{10}P_2Nb_5Cr_1Cu_{0.09}$, respectively, and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were processed by a water atomization method and then classified so as to produce soft magnetic powders having an average grain diameter ranging from 1 μm to 200 μm. Measurement using an X-ray diffraction method was performed on the powders to examine whether to have an amorphous single phase. Next, each of the powders prior to heat treatment was mixed and granulated with a solution of silicone resin such that a weight ratio of the soft magnetic powder and the solid content of the silicone resin was 100/5. Press forming was conducted on the granulated powders under a forming pressure of 1000 MPa so as to produce molded bodies (dust cores) having a toroidal shape with an outside diameter of 18 mm, an inside diameter of 12 mm, and a thickness of 3 mm. Then heat treatment was performed on each molded body to harden the silicone resin as a binder, thereby producing dust cores for evaluation. Moreover, heat treatment was performed on the produced dust core having the $Fe_{73.91}B_{11}P_6Si_7Nb_1Cr_1Cu_{0.09}$ composition at a temperature of 400° C. for 60 minutes and on the produced dust core having the $Fe_{79.9}Si_2B_{10}P_2Nb_5Cr_1Cu_{0.09}$ composition at a temperature of 600° C. for 10 minutes, thereby producing samples for evaluation. Furthermore, forming was conducted under the same conditions on the powder having the Fe composition and the powder having the $Fe_{88}Si_3Cr_9$ composition produced by water atomization, as conventional materials. Heat treatment was performed on the Fe powder at a temperature of 500° C. for 60 minutes and on the $Fe_{88}Si_3Cr_9$ powder at a temperature of 700° C. for 60 minutes. Furthermore, the core loss of the dust core samples was measured under excitation conditions of 100 kHz and 100 mT with use of a BH analyzer. Table 13 shows the measurement results of the grain diameter of the powders and the core loss Pcv of the dust cores with regard to the amorphous alloy compositions according to Examples 278-287 of the present invention and Comparative Examples 77-80.

TABLE 13

| | Alloy Composition (at %) | Average Grain Diameter of Powder (μm) | Pcv (mW/cc) |
|---|---|---|---|
| Example 278 | $Fe_{73.91}B_{11}P_6Si_7Nb_1Cr_1Cu_{0.09}$ | 1 | 1020 |
| Example 279 | | 2 | 980 |
| Example 280 | | 10 | 1000 |
| Example 281 | | 32 | 1140 |
| Example 282 | | 150 | 1800 |
| Comparative Example 77 | | 220 | 5200 |

TABLE 13-continued

| | Alloy Composition (at %) | Average Grain Diameter of Powder (μm) | Pcv (mW/cc) |
|---|---|---|---|
| Example 283 | $Fe_{79.91}B_{10}P_2Si_2Nb_5Cr_1Cu_{0.09}$ | 1 | 880 |
| Example 284 | | 2 | 780 |
| Example 285 | | 10 | 820 |
| Example 286 | | 38 | 1020 |
| Example 287 | | 150 | 1440 |
| Comparative Example 78 | | 225 | 4950 |
| Comparative Example 79 | Fe | 10 | 6320 |
| Comparative Example 80 | $Fe_{88}Si_3Cr_9$ | 10 | 4900 |

As shown in Table 13, each of the amorphous alloy compositions of Examples 278-287 could have a core loss Pcv lower than 4900 mW/cc by using soft magnetic powder having a proper powder grain diameter.

The compositions of Examples 278-287 and Comparative Examples 77 and 78 listed in Table 13 correspond to powder grain diameters from 1 μm to 225 μm. Examples 278-287 met conditions of Pcv<4900 mW/cc. The powder grain diameter of the present invention is in a range of 150 nm or less. In the cases of Comparative Examples 77 and 78 where the average grain diameter of the powder was 220 μm and 225 μm, respectively, the core loss Pcv was lowered, so that the aforementioned conditions were not met.

EXAMPLE 288

Figure 2A:
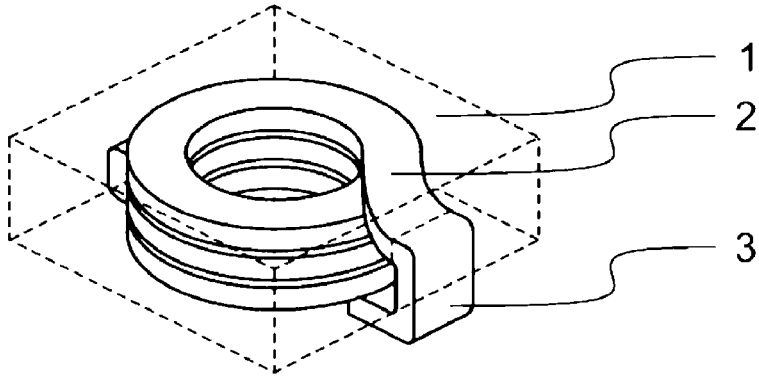
FIG. 2(*a*) is a perspective view showing an inductor according to the example in which a coil can be seen through the inductor.
Figure 2B:
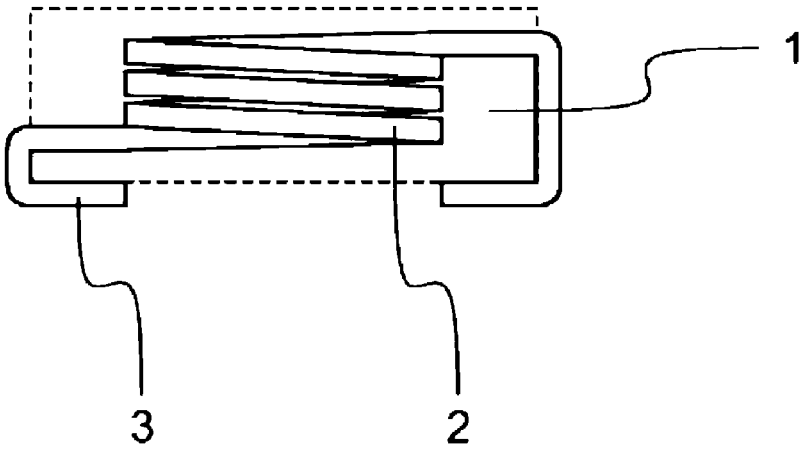
Figure 3:
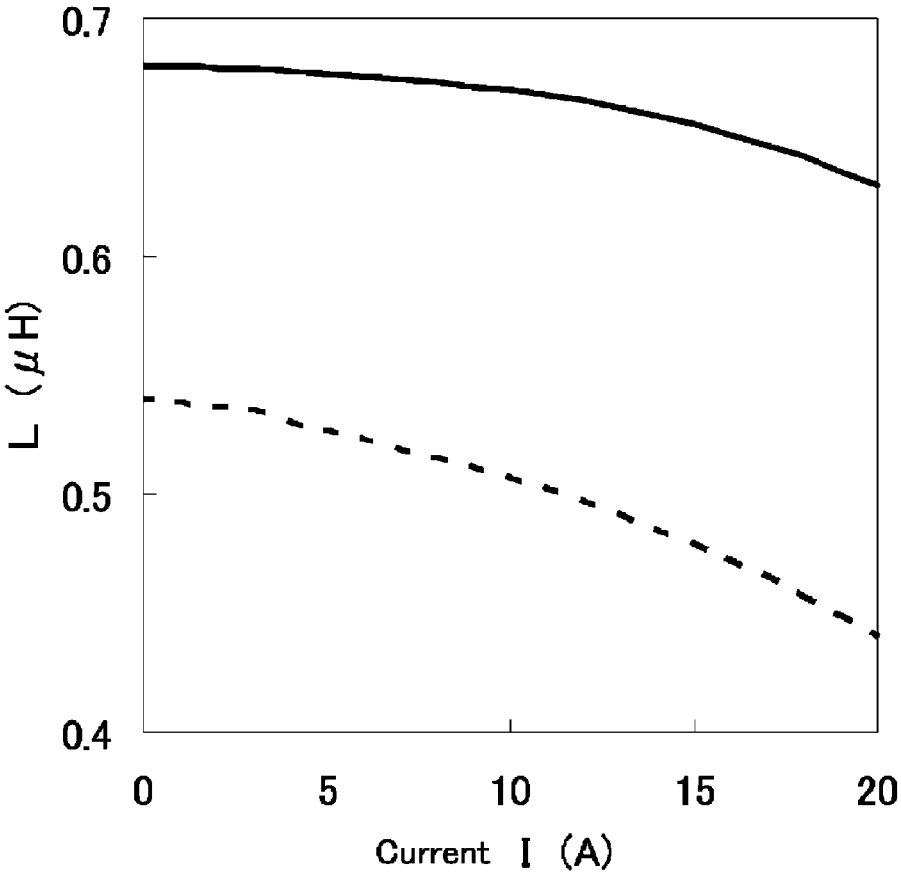
FIG. 3 is a superimposed direct current characteristic curve of the inductor of the example.
Figure 4:
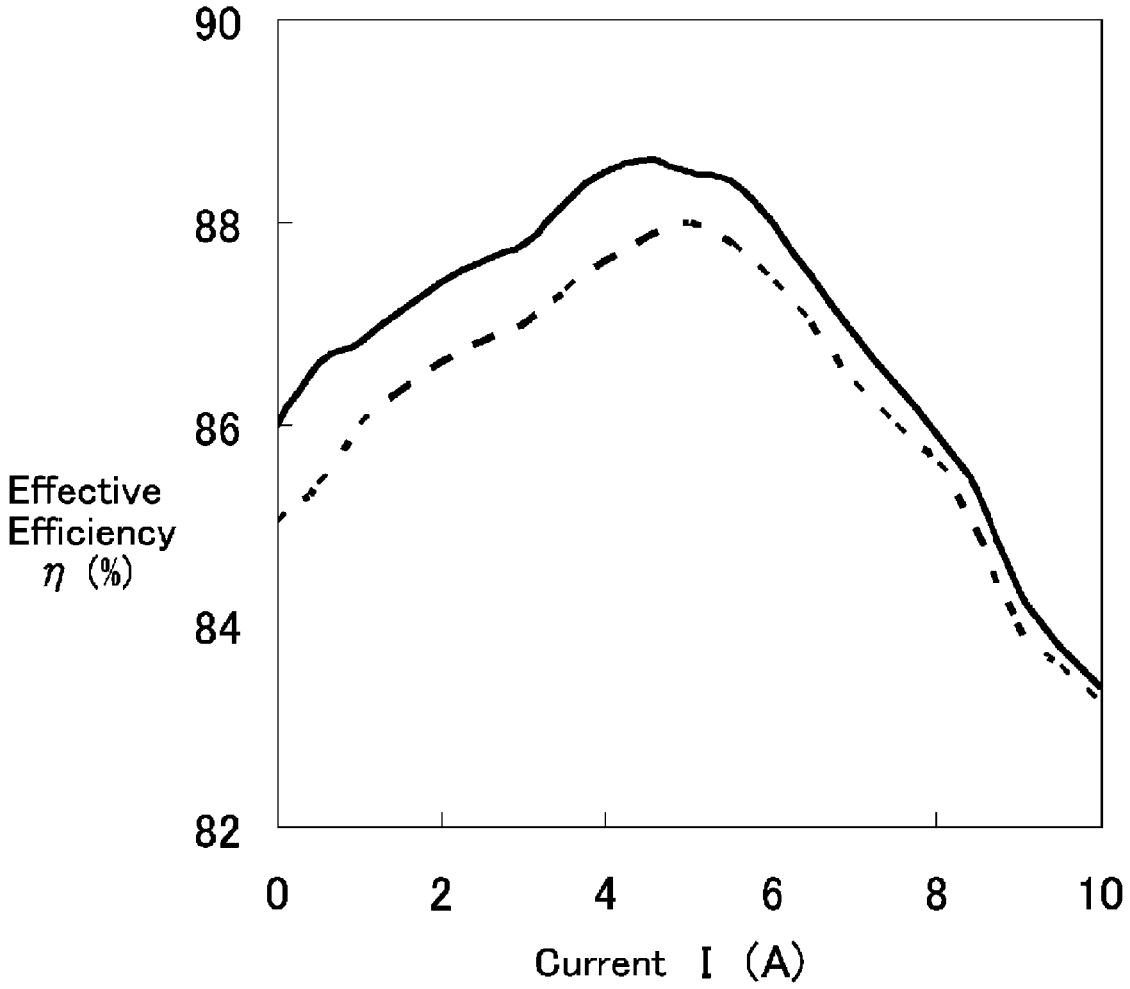
FIG. 4 is a graph showing the implementation efficiency of the inductor of the example.

Next, there will be described the evaluation results of an inductor produced by providing a coil on a dust core formed of soft magnetic powder according to the present invention. The produced inductor was an integrated inductor in which a coil is provided inside of a dust core. FIGS. 2(*a*) and 2(*b*) are views showing the inductor of this example. FIG. 2(*a*) is a perspective view in which the coil can be seen through the inductor, and FIG. 2(*b*) is a side view in which the coil can similarly be seen through the inductor. In FIGS. 2(*a*) and 2(*b*), the reference numeral 1 denotes the dust core, the outline of which is shown by the dashed lines, the reference numeral 2 denotes the coil, and the reference numeral 3 denotes a terminal for surface mounting. First, a sample weighed so as to have the composition of $Fe_{79.9}Si_2B_{10}P_2Nb_5Cr_1Cu_{0.09}$ shown in Example 2 was prepared as a material according to the present invention. This sample was then placed in an alumina crucible, subjected to evacuation, and melted within a reduced-pressure Ar atmosphere by high-frequency heating to produce a master alloy. Then a powder having an average grain diameter of 10 μm was produced with use of the produced master alloy by a water atomization method. Next, heat treatment was performed on the powder at a temperature of 600° C. for 15 minutes to produce a material powder. A solution of silicone resin was added as a binder to the material powder. Granulation was performed along with mixing and mulling until the mixture was uniformized. The solvent was removed by drying, thereby producing granulated material powder. A weight ratio of the soft magnetic powder and the solid content of the silicone resin was 100/5. Next, a coil 2 shown in FIGS. 2(*a*) and 2(*b*) was prepared. The coil 2 had a cross-sectional shape of 2.0 mm×0.6 mm. The coil 2 was formed by wounding edgewise a flat type conductor having an insulating layer of polyamide-imide formed on a surface thereof with a thickness of 20 μm. The number of turns was 3.5. The aforementioned material powder was filled in a cavity of a die in such a state that the coil 2 was placed within the die. Forming was conducted under a pressure of 800 MPa. Next, the compact was withdrawn from the die, and a hardening process of the binder was performed. Forming was conducted on a portion that extended outside of the compact of the coil terminal, thereby providing a terminal 3 for surface mounting. Then heat treatment was performed at a temperature of 400° C. for 15 minutes. The superimposed direct current characteristics and the implementation efficiency were measured for the inductor thus obtained. FIG. 3 shows the superimposed direct current characteristics of the inductor of this example, and FIG. 4 shows the implementation efficiency of the inductor of this example. Here, this example is indicated by solid lines, and the comparative example is indicated by dashed lines. The comparative example of FIG. 3 used an inductor prepared in the same manner as this example except that a powder in which an Fe-based amorphous powder and an Fe powder were mixed with a weight ratio of 6/4 was used. In the implementation efficiency of the inductors shown in FIG. 5, the forming pressure was adjusted so that L=0.6 μH for the inductors of this example and the comparative example. As is apparent from FIGS. 3 and 4, the inductor of the present example exhibited more excellent characteristics than the comparative example.

EXAMPLES 289-291 AND COMPARATIVE EXAMPLES 81-83

Materials of Fe, B, $Fe_{75}P_{25}$, Si, $Fe_{80}C_{20}$, Cu, Nb, Cr, Ga, and Al were respectively weighed so as to provide alloy compositions of Examples 289-291 of the present invention and Comparative Examples 81-83 as listed in Table 14 below and put into an alumina crucible. The crucible was placed within a vacuum chamber of a high-frequency induction heating apparatus, which was evacuated. Then the materials were melted within a reduced-pressure Ar atmosphere by high-frequency induction heating to produce master alloys. The master alloys were poured into a copper mold with a cylindrical hole having a diameter of 1 mm and a copper mold with a plate-like hole having a thickness of 0.3 mm and a width of 5 mm, respectively, by a copper mold casting method so as to produce rod-like samples having various diameters and a length of about 15 mm Cross-sections of those rod-like samples were evaluated by an X-ray diffraction method to determine whether to have an amorphous single phase or a crystal phase. Additionally, the supercooled liquid region ΔTx was calculated from measurement of the glass transition temperature Tg and the crystallization temperature Tx by DSC, and the saturation magnetic flux density Bs was measured by VSM. Table 14 shows the measurement results of the saturation magnetic flux density Bs, the supercooled liquid region ΔTx, and the X-ray diffraction of the 1-mm diameter rod-like members and the 0.3-mm thickness plate members with regard to the amorphous alloys having the compositions according to Examples 289-291 of the present invention and Comparative Examples 81-83.

TABLE 14

| | Alloy Composition (at %) | Bs (T) | ΔTx (° C.) | X-ray Diffraction Results of 1-mm Diameter Rod-like Member | X-ray Diffraction Results of 0.3-mm Thickness Plate Member |
|---|---|---|---|---|---|
| Comparative Example 81 | $Fe_{78}Si_9B_{13}$ | 1.55 | 0 | Crystal Phase | Crystal Phase |
| Comparative Example 82 | $(Fe_{0.75}Si_{0.1}B_{0.15})_{96}Nb_4$ | 1.18 | 32 | Amorphous Phase | Amorphous Phase |
| Comparative Example 83 | $Fe_{72}Al_5Ga_2P_{10}C_6B_4Si_1$ | 1.13 | 53 | Amorphous Phase | Amorphous Phase |
| Example 289 | $Fe_{73.91}B_{11}P_6Si_7Nb_1Cr_1Cu_{0.09}$ | 1.36 | 52 | Amorphous Phase | Amorphous Phase |
| Example 290 | $Fe_{75.91}Si_6B_{10}P_6C_2Cu_{0.09}$ | 1.49 | 53 | Amorphous Phase | Amorphous Phase |
| Example 291 | $Fe_{77.91}Si_7B_{10}P_4Cr_1Cu_{0.09}$ | 1.47 | 20 | Amorphous Phase | Amorphous Phase |

As shown in Table 14, each of the amorphous alloy compositions of Examples 289-291 could produce a plate member of an amorphous single phase with a thickness of at least 0.3 mm or a rod-like member of an amorphous single phase with a diameter of at least 1 mm by a copper mold casting method. Each of the amorphous alloy compositions had a saturation magnetic flux density Bs of at least 1.20 T. Comparative Example 81 had a low capability of forming an amorphous phase. Furthermore, Comparative Examples 82 and 83 had a saturation magnetic flux density Bs lower than 1.20 T. Thus, the aforementioned conditions were not met in those comparative examples.

As shown in Table 14, the compositions of Examples 289-291 and Comparative Examples 81-83 correspond to cases where the supercooled liquid region ΔTx is varied from 0° C. to 55° C. Each of the compositions of Examples 289-291 could produce a plate member of an amorphous single phase with a thickness of at least 0.3 mm or a rod-like member of an amorphous single phase with a diameter of at least 1 mm by a copper mold casting method. Each of the compositions had a saturation magnetic flux density Bs of at least 1.20 T. In this case, it is preferable to maintain the supercooled liquid region of at least 20° C. Thus, plate members of an amorphous single phase with a thickness of at least 0.3 mm or rod-like members of an amorphous single phase with a diameter of at least 1 mm can be produced by a copper mold casting method. With an alloy composition having a supercooled liquid region, powder or ribbons can readily be produced.

As can be seen from the foregoing results, a soft magnetic alloy according to a first embodiment and a second embodiment can have an excellent capability of forming an amorphous phase by limiting its composition. Thus, it is possible to obtain various members, such as powder, ribbons, and bulk members. Furthermore, an excellent soft magnetic property can be obtained by performing proper heat treatment. Moreover, nanocrystal grains of 50 nm or less can be deposited in an amorphous phase by further limiting the composition, thereby providing a high saturation magnetic flux density. Additionally, it has been found that use of a soft magnetic ribbon or powder according to the first embodiment and the second embodiment can provide a wound magnetic core, a multilayer magnetic core, a dust core, or the like with a high magnetic permeability and a low core loss. Furthermore, it has been found that an inductor produced by using the resultant wound magnetic core, multilayer magnetic core, dust core, or the like has more excellent properties than an inductor produced by using conventional materials. Therefore, when a soft magnetic alloy according to the present invention is used as a material for an inductor, which is an important electronic component, it can make a great contribution to improvement of the inductor characteristics and reduction of the size and weight. Particularly, because improvement in implementation efficiency will make a large contribution to energy conservation, the present invention is useful in view of environmental issues. While embodiments and examples of the present invention have been described with reference to the accompanying drawings, the technical scope of the present invention is not affected by the aforementioned embodiments and examples. It would be apparent to those skilled in the art that various changes and modifications may be made therein without departing from the scope of the technical concept specified in claims. It is understood that those changes and modifications should fall within the technical scope of the present invention.

The invention claimed is:

1. The soft magnetic alloy comprising an Fe-based alloy composition has components represented by the following formula:

$$(Fe_{1-a}M^1_a)_{100-b-c-d-e-f-g}M^2_bB_cP_dCu_eM^3_fM^4_g$$

where $M^1$ is at least one element selected from the group consisting of Co and Ni, $M^2$ is at least one element selected from the group consisting of Nb, Mo, Zr, Ta, W, Hf, Ti V, Cr, and Mn, $M^3$ is at least one element selected from the group consisting of elements of a platinum group, element selected from the group consisting of Pd, Pt, Rh, Ir, Ru, and Os, rare-earth element selected from the group consisting of Sc, Y, La, Ce, Pr, Nd, Sm, Eu, Gd, Tb, dy, Ho, Er, Tm, Yb, and Lu, Au, Ag, Zn, Sn, Sb, In, Rb, Sr, Cs, and Ba, $M^4$ is at least one element selected from the group consisting of C, Si, Al, Ga, and Ge, a, b, c, d, e, f, and g are values that conditions that $0 \leqq a \leqq 0.5$, $0 \leqq b \leqq 5$, $5 \leqq c \leqq 25$, $0.2 \leqq d \leqq 10$, $0 < e \leqq 1.0$, $0 \leqq f \leqq 2$, $1 \leqq g \leqq 8$, and $70 \leqq 100-b-c-d-e-f-g$.

2. The soft magnetic alloy as recited in claim 1, wherein the $M^2$ is Cr in a amount of at least 0.1 atomic %.

3. The soft magnetic alloy as recited in claim 1, having a supercooled liquid region represented by ΔTx (supercooled liquid region)=Tx (temperature at which crystallization starts)−Tg (glass transition temperature).

4. The soft magnetic alley as recited in claim 3, wherein ΔTx (supercooled liquid region) is at least 20° C.

5. A soft magnetic ribbon formed the soft magnetic alloy as recited in claim 1, having a thickness in a range of from 10 μm to 300 μm.

6. A wound magnetic core or a multilayer magnetic core formed of the soft magnetic ribbon as recited in claim 5.

7. A soft magnetic member formed of the soft magnetic alloy as recited in claim 1, having a plate-like shape having a thickness of at least 0.3 mm or a rod-like shape having an outside diameter of at least 1 mm.

8. A soft magnetic member formed of the soft magnetic alloy as recited in claim 1, having a plate-like or rod-like portion haying a thickness of at lease 1 mm.

9. A soft magnetic powder formed of the soft magnetic alloy as recited in claim 1, having an average powder particle diameter in a range of from 1 μm to 150 μm.

10. A soft magnetic powder formed of the soft magnetic alloy as recited in claim 1, produced by a water atomization method.

11. A dust core produced by molding a mixture including the soft magnetic powder as recited in claim 9 and a binder for insulating and binding the soft magnetic powder.

12. An inductor, having a wound magnetic core or a multilayer magnetic core as recited in claim 6, which is disposed near a coil.

13. A method of manufacturing a soft magnetic ribbon or a powder, the method comprising:

a step (a) of rapidly cooling and solidifying the Fe-based alloy composition as recited in claim 1, in molten state so as to form a ribbon or a powder; and a step (b) of performing heat treatment on the powder at temperature in a range of from 400° C. to 700° C.

14. A method of manufacturing a wound magnetic core, a multilayer magnetic core, the method comprising a step of performing heat treatment on the wound magnetic core or the multilayer magnetic core as recited in claim 6, at a temperature in a range of from 400° C. to 700° C.

15. A method of manufacturing an inductor, the method comprising:

a step (c) of making a mixture mainly including the soft magnetic powder as recited in claim 9, and a hinder for insulating and binding the soft magnetic power to obtain a green compact;

a step (d) of disposing the green compact near a coil; and a step (e) of performing heat treatment on the green compact at a temperature in a range of from 400° C. to 700° C.

16. A method of manufacturing an inductor, the method comprising:

a step (f) of molding a mixture integrally with a coil to obtain an integrated molded body, the mixture mainly including the soft magnetic powder as recited in claim 9, and a binder for insulating and binding the soft magnetic powder; and a step (g) of performing heat treatment on the integrated molded body at a temperature in a range of from 400° C. to 700° C.

17. A method of manufacturing a wound magnetic core, a multilayer magnetic core, a dust core, or an inductor using the soft magnetic alloy as recited in claim 1, the method comprising a step of performing heat treatment at a temperature in a range of from 300° C. to 600° C.

18. An inductor, having a dust core as recited in claim 11, which is disposed near a coil.

19. A method of manufacturing a dust core, the method comprising a step of performing heat treatment on the dust core as recited in claim 11, at a temperature in a range of from 400° C. to 700° C.

20. The soft magnetic alloy as recited in claim 1, wherein $5 \leqq c \leqq 18$.

21. The soft magnetic alloy as recited in claim 1, wherein $0 < e < 0.09$.

* * * * *